US008001959B2

(12) United States Patent
Ford et al.

(10) Patent No.: US 8,001,959 B2
(45) Date of Patent: Aug. 23, 2011

(54) SELF-HEATING CONTAINER

(75) Inventors: John M. B. Ford, Cordova, TN (US); Douglas M. Lund, Hillsbourgh, NJ (US)

(73) Assignee: Heat Wave Technologies, LLC, Marina del Rey, CA (US)

( * ) Notice: Subject to any disclaimer, the term of this patent is extended or adjusted under 35 U.S.C. 154(b) by 0 days.

(21) Appl. No.: 11/559,878

(22) Filed: Nov. 14, 2006

(65) Prior Publication Data

US 2007/0131219 A1 Jun. 14, 2007

Related U.S. Application Data

(60) Provisional application No. 60/736,485, filed on Nov. 14, 2005.

(51) Int. Cl.
*F24J 1/00* (2006.01)

(52) U.S. Cl. ..... 126/263.09; 126/263.01; 126/263.05; 126/263.06; 126/263.08; 62/4; 62/60; 62/457.3

(58) Field of Classification Search ..... 126/263.09, 126/263.01, 263.05, 263.06, 263.08, 373.1; 62/294, 4, 60, 457.3, 457.2, 530; 215/11.1, 215/11.2, 11.3
See application file for complete search history.

(56) References Cited

U.S. PATENT DOCUMENTS

| | | | | |
|---|---|---|---|---|
| 827,222 | A | 7/1906 | Esspenhayn et al. | |
| 1,971,364 | A | 8/1933 | Zimmer et al. | |
| 2,300,793 | A * | 11/1942 | Martin | 126/263.08 |
| 2,556,893 | A | 10/1947 | Zwiebach et al. | |
| 2,482,779 | A | 9/1949 | Katz | |
| 2,620,788 | A | 12/1952 | Rivoche et al. | |
| 3,003,324 | A | 10/1961 | Vance et al. | |
| 3,213,932 | A | 10/1965 | Gottfurcht et al. | |
| 3,369,369 | A | 2/1968 | Weiss | |
| 3,561,424 | A * | 2/1971 | Failla | 126/263.09 |
| 3,653,372 | A | 4/1972 | Douglas | |
| 3,683,889 | A | 8/1972 | Hoffman | |
| 3,874,557 | A | 4/1975 | Porter | |
| 3,970,068 | A | 7/1976 | Sato | |
| 4,528,218 | A | 7/1985 | Maione | |
| 4,559,921 | A | 12/1985 | Benmussa | |

(Continued)

FOREIGN PATENT DOCUMENTS

CA 2235678 5/1997

(Continued)

OTHER PUBLICATIONS

Torrone, "Inside a Wolfgang Puck Self-Heating Can . . . ", MakeZine.com, pp. 1-11 (Nov. 21, 2005) http://www.makezine.com/extras/48.html.

(Continued)

*Primary Examiner* — Steven B McAllister
*Assistant Examiner* — Avinash Savani
(74) *Attorney, Agent, or Firm* — Knobbe, Martens, Olson & Bear, LLP

(57) ABSTRACT

Disclosed is various embodiments of a self-heating or self-cooling container with a number of improved features in overcoming the problems associated with existing containers, including, but not limited to, an improved breaking device designed to maximize the mixture and reaction between different reactants, an insulating lip to prevent heat loss in the heating process, a simple and efficient design of the container, and enhancements in manufacturing and assembling a self-heating or self-cooling container.

22 Claims, 36 Drawing Sheets

U.S. PATENT DOCUMENTS

| | | | | |
|---|---|---|---|---|
| 4,640,264 | A | 2/1987 | Yamaguchi et al. | |
| 4,741,324 | A * | 5/1988 | Ina et al. | 126/263.06 |
| 4,751,119 | A | 6/1988 | Yukawa | |
| 4,752,310 | A | 6/1988 | Maier-Laxhuber et al. | |
| 4,753,085 | A | 6/1988 | Labrousse | |
| 4,762,113 | A | 8/1988 | Hamasaki | |
| 4,773,389 | A | 9/1988 | Hamasaki | |
| 4,779,609 | A | 10/1988 | Oblon | |
| 4,784,113 | A | 11/1988 | Nagai et al. | |
| 4,784,678 | A | 11/1988 | Rudick et al. | |
| 4,793,323 | A * | 12/1988 | Guida et al. | 126/263.08 |
| 4,802,343 | A | 2/1989 | Rudick et al. | |
| 4,823,769 | A | 4/1989 | Semaan | |
| 4,838,242 | A | 6/1989 | Oblon | |
| 4,895,135 | A | 1/1990 | Hamasaki | |
| 4,928,495 | A | 5/1990 | Siegel | |
| 4,989,729 | A | 2/1991 | Huang | |
| 4,993,237 | A | 2/1991 | Bond et al. | |
| 5,168,708 | A | 12/1992 | Siegel | |
| 5,197,302 | A | 3/1993 | Sabin et al. | |
| 5,220,909 | A | 6/1993 | Pickard et al. | |
| 5,230,216 | A | 7/1993 | Siegel | |
| 5,255,812 | A | 10/1993 | Hsu | |
| 5,263,991 | A | 11/1993 | Wiley | |
| 5,388,565 | A * | 2/1995 | Ou | 126/263.08 |
| 5,392,762 | A | 2/1995 | Hsu | |
| 5,461,867 | A | 10/1995 | Scudder et al. | |
| 5,465,707 | A | 11/1995 | Fulcher et al. | |
| 5,626,022 | A | 5/1997 | Scudder et al. | |
| 5,628,304 | A * | 5/1997 | Freiman | 126/263.09 |
| 5,809,786 | A | 9/1998 | Scudder et al. | |
| 5,979,164 | A | 11/1999 | Scudder et al. | |
| 6,065,300 | A | 5/2000 | Anthony | |
| 6,079,405 | A | 6/2000 | Justo | |
| 6,105,384 | A * | 8/2000 | Joseph | 62/293 |
| 6,123,065 | A | 9/2000 | Teglbjarg | |
| 6,141,970 | A | 11/2000 | Molzahn et al. | |
| 6,178,753 | B1 | 1/2001 | Scudder et al. | |
| 6,234,165 | B1 * | 5/2001 | Creighton et al. | 126/263.06 |
| 6,266,879 | B1 | 7/2001 | Scudder et al. | |
| 6,338,252 | B1 | 1/2002 | Calderaio | |
| 6,351,953 | B1 | 3/2002 | Scudder et al. | |
| 6,481,214 | B2 | 11/2002 | Peters et al. | |
| 6,484,514 | B1 | 11/2002 | Joseph | |
| 6,502,407 | B1 * | 1/2003 | Searle et al. | 62/4 |
| 6,513,516 | B2 | 2/2003 | Sabin et al. | |
| 6,564,558 | B1 | 5/2003 | Seymour et al. | |
| 6,601,577 | B2 | 8/2003 | Bouskila et al. | |
| 6,644,383 | B2 | 11/2003 | Joseph | |
| 6,705,309 | B2 | 3/2004 | Searle et al. | |
| 6,829,902 | B1 | 12/2004 | Claydon | |
| 6,877,504 | B2 | 4/2005 | Schreff et al. | |
| 6,986,435 | B2 | 1/2006 | Sagal et al. | |
| 7,004,161 | B2 | 2/2006 | Kolb | |
| 7,021,064 | B2 | 4/2006 | Wohland et al. | |
| 7,025,055 | B2 | 4/2006 | Scudder et al. | |
| 7,107,783 | B2 | 9/2006 | Smolko et al. | |
| 7,117,684 | B2 | 10/2006 | Scudder et al. | |
| 7,118,005 | B2 | 10/2006 | Shimazaki | |
| 7,150,354 | B2 | 12/2006 | Snell | |
| 7,240,507 | B2 | 7/2007 | Jeuch | |
| 2001/0039947 | A1 * | 11/2001 | Searle | 126/263.02 |
| 2002/0129610 | A1 * | 9/2002 | Searle | 62/4 |
| 2002/0159247 | A1 | 10/2002 | Katzman | |
| 2003/0038140 | A1 * | 2/2003 | Sagal et al. | 220/592.2 |
| 2003/0205224 | A1 | 11/2003 | Kolb | |
| 2005/0155599 | A1 | 7/2005 | Maxwell et al. | |
| 2005/0160743 | A1 | 7/2005 | Dunwoody | |
| 2005/0198969 | A1 * | 9/2005 | Scudder et al. | 62/4 |
| 2006/0086097 | A1 | 4/2006 | Guida | |
| 2006/0118103 | A1 | 6/2006 | Schreff et al. | |
| 2006/0137535 | A1 | 6/2006 | Searle et al. | |
| 2006/0162344 | A1 * | 7/2006 | Scudder et al. | 62/4 |
| 2006/0169276 | A1 | 8/2006 | Scudder et al. | |
| 2006/0186125 | A1 | 8/2006 | Tew | |
| 2006/0191272 | A1 | 8/2006 | Wohland et al. | |
| 2006/0191283 | A1 | 8/2006 | Overgaard | |
| 2006/0196882 | A1 | 9/2006 | Shimazaki et al. | |
| 2006/0201165 | A1 | 9/2006 | Martino et al. | |
| 2006/0213205 | A1 | 9/2006 | Reverendo | |
| 2006/0248910 | A1 | 11/2006 | Smolko et al. | |
| 2006/0260326 | A1 | 11/2006 | Hickey | |
| 2006/0283194 | A1 | 12/2006 | Flanagan | |
| 2006/0289565 | A1 | 12/2006 | Manzo et al. | |
| 2007/0006871 | A1 * | 1/2007 | Strachan | 126/263.09 |
| 2007/0006872 | A1 | 1/2007 | Strachan | |
| 2007/0125362 | A1 | 6/2007 | Ford et al. | |
| 2007/0157921 | A1 | 7/2007 | Rankin | |
| 2007/0163569 | A1 | 7/2007 | Strachan | |
| 2007/0167341 | A1 | 7/2007 | Burt | |
| 2009/0314667 | A1 | 12/2009 | Beyers | |
| 2010/0224510 | A1 | 9/2010 | Ford et al. | |
| 2010/0227027 | A1 | 9/2010 | Ford et al. | |

FOREIGN PATENT DOCUMENTS

| | | | |
|---|---|---|---|
| EP | 1120072 | B1 | 11/2002 |
| EP | 1534607 | B1 | 8/2006 |
| EP | 1749465 | | 2/2007 |
| EP | 1 956 950 | B1 | 9/2009 |
| GB | 225104 | A | 10/1989 |
| GB | 2422659 | | 8/2006 |
| GB | 2429055 | | 2/2007 |
| JP | 01-196227 | A2 | 1/1988 |
| JP | 01-266130 | A2 | 4/1988 |
| JP | 01-274002 | A2 | 5/1988 |
| JP | 02-217061 | | 2/1989 |
| JP | 03-102397 | | 9/1989 |
| JP | 03-170259 | | 12/1989 |
| JP | 05-258202 | A2 | 2/1992 |
| JP | 04-117921 | A2 | 4/1992 |
| JP | 2009-515785 | | 4/2009 |
| NL | 7401810 | A | 12/1974 |
| WO | WO 9317928 | A1 | 9/1993 |
| WO | WO 97/00637 | | 1/1997 |
| WO | WO 9749319 | | 12/1997 |
| WO | WO 0192128 | A1 | 5/2000 |
| WO | WO 01/24672 | A1 | 4/2001 |
| WO | WO 02085748 | A1 | 10/2002 |
| WO | WO 02098761 | A1 | 12/2002 |
| WO | WO 2004/022450 | | 3/2004 |
| WO | WO 2005037953 | A1 | 4/2005 |
| WO | WO 2005108878 | A2 | 11/2005 |
| WO | WO 2005115872 | A1 | 12/2005 |
| WO | WO 2006009878 | A2 | 1/2006 |
| WO | WO 2006091182 | A1 | 8/2006 |
| WO | WO 2006093849 | A1 | 9/2006 |
| WO | WO 2006100412 | | 9/2006 |
| WO | WO 2006101483 | | 9/2006 |
| WO | WO 2006109098 | | 10/2006 |
| WO | WO 2006117543 | | 11/2006 |
| WO | WO 2007016416 | | 2/2007 |
| WO | WO 2007070893 | A1 | 6/2007 |
| WO | WO 2007080359 | A1 | 6/2007 |
| WO | WO 2009/145657 | A1 | 3/2009 |
| WO | WO 2010/104889 | | 9/2010 |

OTHER PUBLICATIONS

Mok Zhenyuan et al., MGMT 002 Technology & World Change, "Business Plan Report: HeatUp® Food Warming Ware by Exotherm", Singapore Management University, Lee Kong Chian School of Business (Mar. 15, 2005) http://www.research.smu.edu.sg/faculty/twc/TWC2005/entries.htm (Aug. 04, 2005).

Heat Up Final—Power Point presentation http://www.research.smu.edu.sg/faculty/twc/TWC2005/entries.htm (Aug. 04, 2005).

Kita Sangyo Co., Ltd., "Self Heating Can!!" English Edition, pp. 1-9 (May 31, 2002).

Preliminary Report on Patentability with Written Opinion, Application No. PCT/US2006/044174, dated May 22, 2008, 6 pages.

Preliminary Report on Patentability and Written Opinion, Application No. PCT/US2006/044233, dated May 22, 2008, 9 pages.

International Search Report and Written Opinion, Application No. PCT/US2010/026721, dated Jun. 7, 2010, 10 pages.

* cited by examiner

Scale 4:1

Scale 4:1

SELF-HEATING CONTAINER

CROSS-REFERENCE

This application claims priority to U.S. Provisional Application Ser. No. 60/736,485, entitled "Self-Heating Container," filed Nov. 14, 2005, which is herein referenced and incorporated in its entirety.

BACKGROUND

1. Field of the Invention

The present invention relates in general to containers, and more particularly, to improved features in a self-heating container.

2. Background of the Invention

In today's on-the-go consumer society, there is increasing demand for a convenient and effective container which may be used by consumers to heat consumable products, such as coffee, tea, milk, soup, and many other types of beverage or food products, at any time and any location, without having access to any conventional heating means, such as a coffee maker, microwave, cook top, etc. The self-heating technology based on an exothermic reaction between different reagents is often used in designing such containers. Under such self-heating technology, two or more reagents are initially separated by a breakable barrier, and when the heat needs to be generated, the barrier is broken to allow the mixing of the reagents, thereby creating an exothermic reaction for heat generation. Typically, the reagents employed for generating the heat include at least a solid material, such as calcium oxide, and a liquid material, such as water.

Numerous containers have been designed by use of the self-heating technology, but most have very limited use because the designs tend to be overly complicated in order to effect sufficient heat exchange, and as a result, the assembly and manufacturing of the containers may not be reasonably achievable from either a technical or business standpoint.

For example, U.S. Pat. No. 4,793,323 describes a self-heating container which includes an outer insulating envelope and a plastic material vessel provided inside the envelope, where the vessel is divided into an upper and a lower compartments separated by a membrane. The upper compartment holds a solid reagent and the lower compartment holds a liquid reagent. The upper compartment and the lower compartment are separated by an aluminum barrier which is thermally welded to a toroidal surface of the upper compartment. The container further includes a metallic inner container for holding a solid or liquid substance situated within the upper container. A breaking member is integral with the lower compartment and able to break the membrane when pressure is exerted against it. To generate heat, the container is turned upside down and a manual pressure is exerted on the bottom of the lower compartment which causes the barrier to break and the two reagents to mix, thereby generating heat. As any water present in the vicinity of the seal can adversely affect the quality of the seal, filling the lower compartment with water must be done with precision. Therefore, sophisticated testing steps in assembly of the container are required to ensure that the seal is secure. In addition, placing and securing the membrane is also complicated when there are many different parts of the container to be assembled.

Another example is PCT Publication WO 2004/022450 that describes a container including an outer container holding a beverage receptacle inserted therein. The solid reactant is arranged annularly about the beverage receptacle in the upper compartment between the outer container and beverage container, while the liquid reactant, i.e., water, is arranged in the lower compartment between the two containers. A breakable diaphragm extends substantially against the base of the beverage receptacle. A breaking device is provided within the second compartment. Again, assembly of this container is quite complicated. In particular, after the solid reactant is introduced into the outer container, a complex spinning technology has to be used to move the solid reactant in order to make room for the beverage container.

U.S. Pat. No. 6,502,407 describes a container including an external cavity which has the heating means and an internal cavity which holds the beverage. The internal cavity extends within the external cavity. The heating means includes calcium oxide placed in the internal cavity and water provided in the water chamber below the external cavity. The water chamber is separated from the heating means by the external cavity through a lid positioned in between. A plunger is affixed to a button on the base of the container. In operation, the container is inverted and the button is pressed. The depression moves the plunger in a direction to push the lid open and the water is quickly released to mix with calcium oxide in the external cavity so as to create a reaction and generate heat. Because many of the container parts need to be sealed, and seals can be easily broken when the container undergoes a temperature change, the integrity of the container can be jeopardized.

In U.S. Pat. No. 6,266,879, the disclosed container has a container body, a thermic module at one end of the body, and a closure at the other end of the body. The module has an elongated heat-exchanger portion that extends into the container body. The heat-exchanger portion has a corrugated or pleated wall to increase the surface area. A module cap is press-fit in the open end of the module body. A breakable barrier is adhesively attached to the open end of the module cap to seal a reactant inside. An actuator assembly is attached to the end of the container body and has an actuator button which is supported on spline-shaped fingers and further has a breakable actuator barrier. Pointed projections extend from the underside of outer actuator button toward the actuator barrier. In order to heat the substance inside the container, the user will depress the actuator button by exerting a force upon the button, which force then causes the fingers to puncture the barrier and causes the inner actuator button to move toward the barrier such that the distal end of the prong punctures the reaction barrier. Water flows through the barrier and mixes with solid reactant in the thermic module body. The container design in this patent is complex and involve many parts to be assembled.

Most of the existing self-heating containers, as illustrated above, are quite complex in design, expensive and difficult to manufacture, and as a result, are prohibited from being widely commercialized to accommodate most consumers. Therefore, there exists a need for an improved self-heating container to overcome the above-described deficiencies.

SUMMARY OF THE INVENTION

The embodiments of the present invention features various self-heating or self-cooling containers. In general, such a container includes an outer container body, an inner container body, a reactant vessel, a breakable barrier, and a breaking device. The outer container body defines a first chamber comprising a first reactant. The inner container body defines a second chamber adapted to hold a substance to be heated or cooled. The inner container body is preferably disposed within the first chamber. The reactant vessel is preferably provided within the first chamber underneath the inner container body. The reactant vessel includes a second reactant capable of reacting with the first reactant to generate an exothermic or endothermic reaction. The breakable barrier covers the reactant vessel. The breaking device is disposed within the first chamber between the inner container body and the reactant vessel.

In one embodiment, the breaking device includes multiple protrusions evenly arranged through the breaking device to efficiently break the barrier and quickly release the second reactant to mix and react with the first reactant. In one example, the protrusions are multiple cone-shaped structures which taper near the barrier.

In one embodiment, the container further includes an insulating layer disposed along an inside surface of the outer container body. The insulating layer may comprise a textured surface. In another embodiment, the container includes an insulating lip disposed at and secured to an upper end of the outer container and an upper end of the inner container body.

In one embodiment, the breaking device includes a breaking member and a rim extending around an outer perimeter of the breaking device to separate the first chamber into an upper compartment and a lower compartment and thereby keeping the first reactant substantially within the upper compartment. For example, the rim may include multiple extensions where adjacent extensions are separated by a space, and a width of the space is sized to keep the first reactant substantially within the upper compartment.

In another embodiment, the breaking device is configured for breaking the barrier by contacting the outer perimeter of the barrier prior to contacting the center of the barrier to release the second reactant into the first chamber to mix and react with the first reactant.

In still another embodiment, the breaking device is provided within the reactant vessel. The breaking device comprises a lower hub, a plurality of spokes extending radially from the hub, and a plurality of blades extending substantially orthogonally from the spokes.

The containers according to various embodiments of the present invention are simple in design and cost efficient to manufacture.

BRIEF DESCRIPTION OF THE DRAWINGS

Figure 1A:
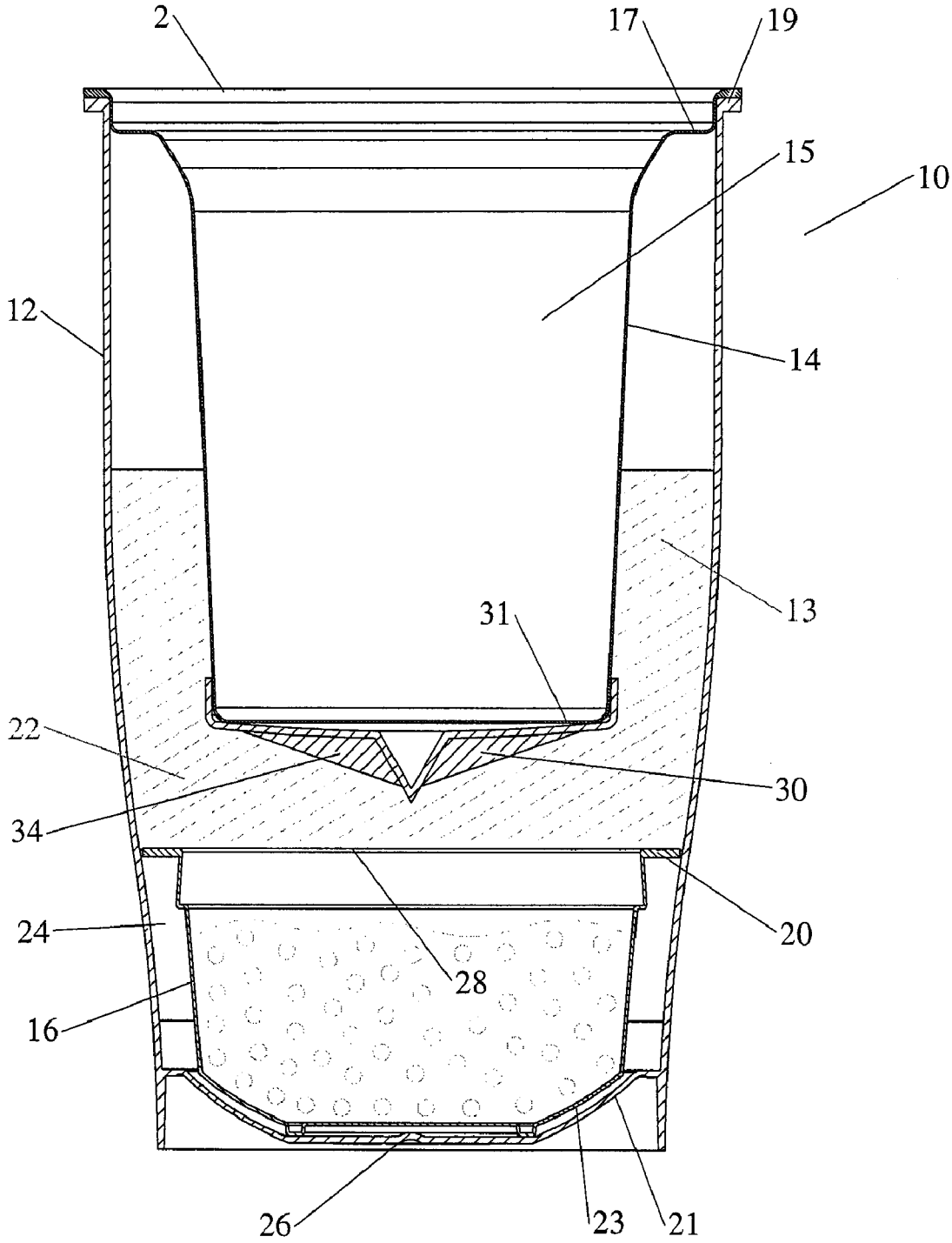
Figure 1B:
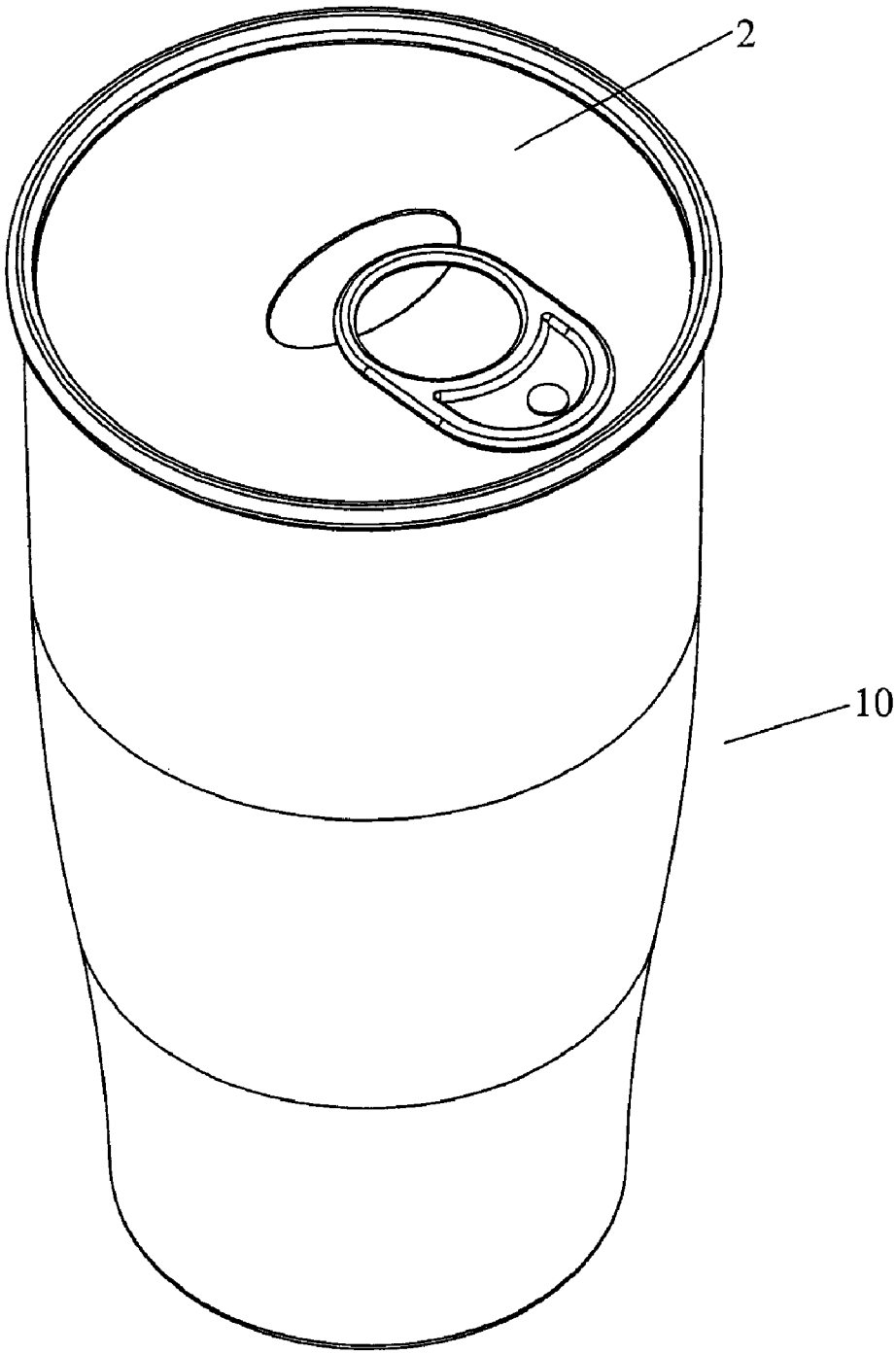
Figure 1C:
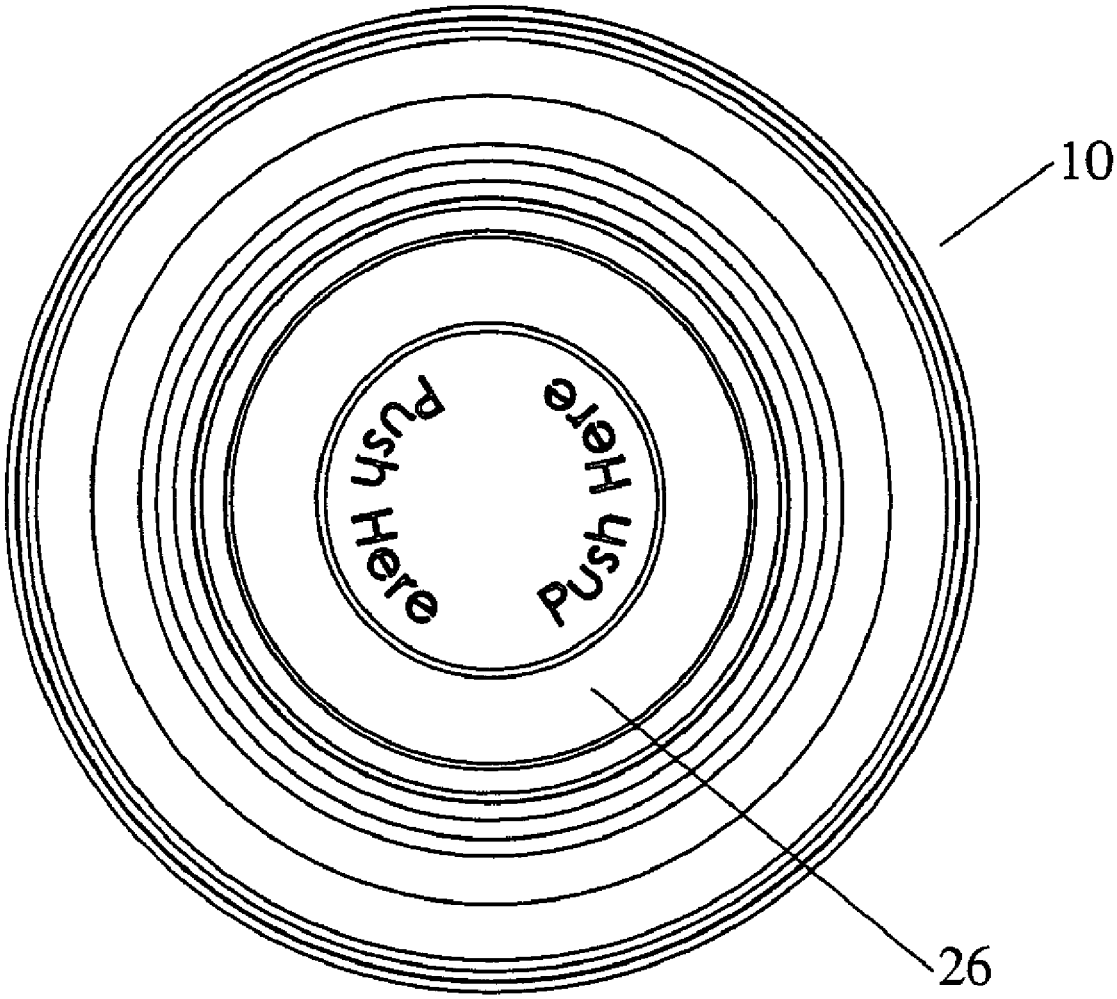
Figure 1D:
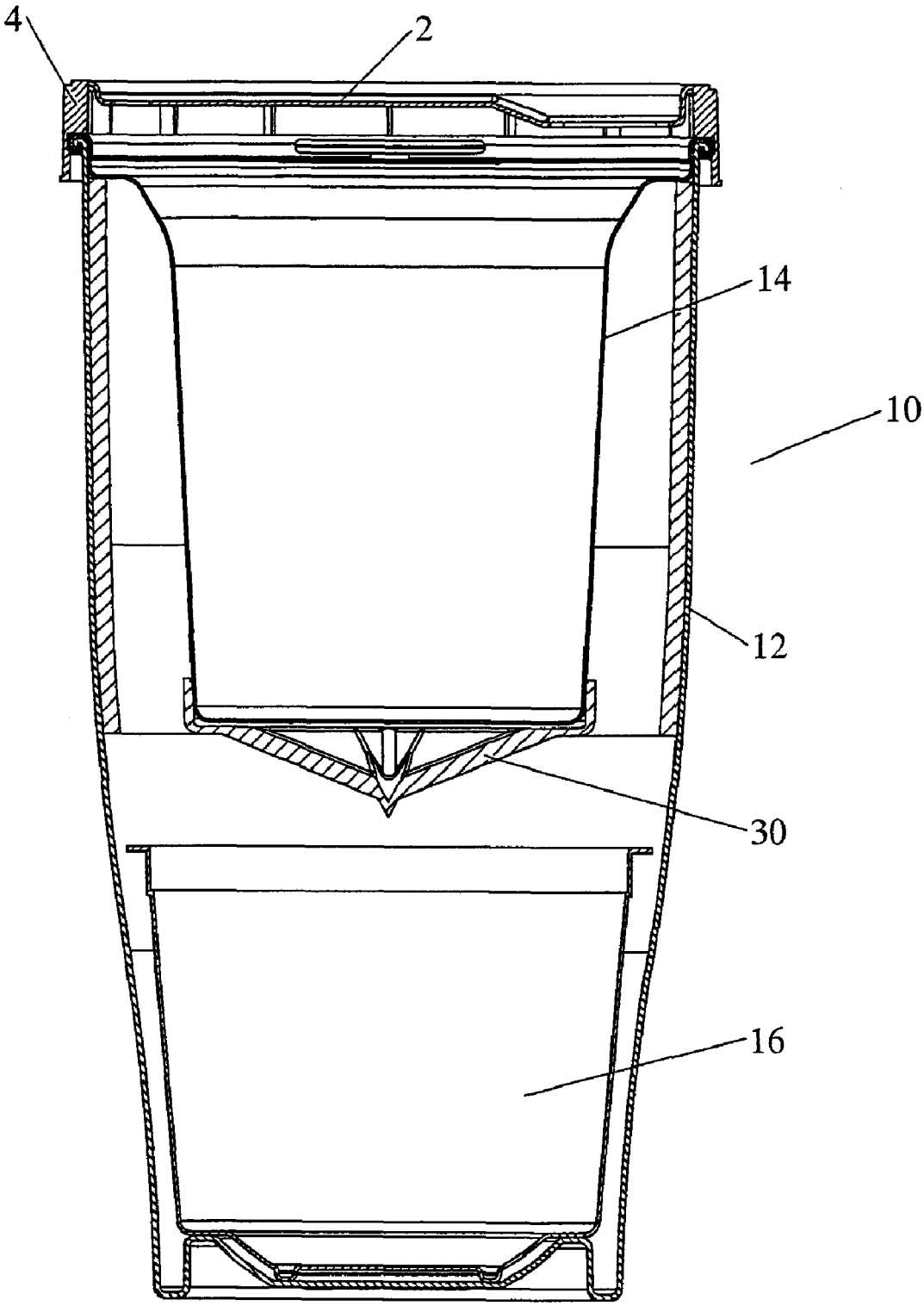
Figure 1E:
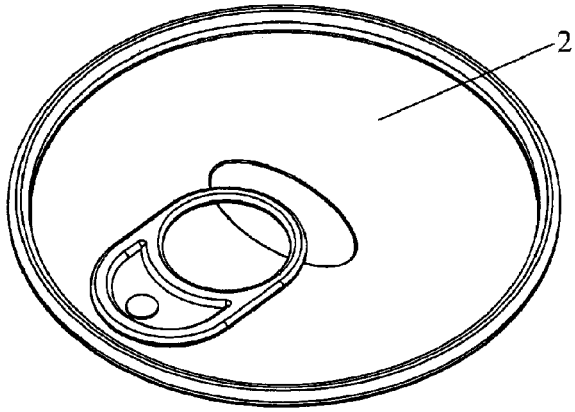
Figure 1I:
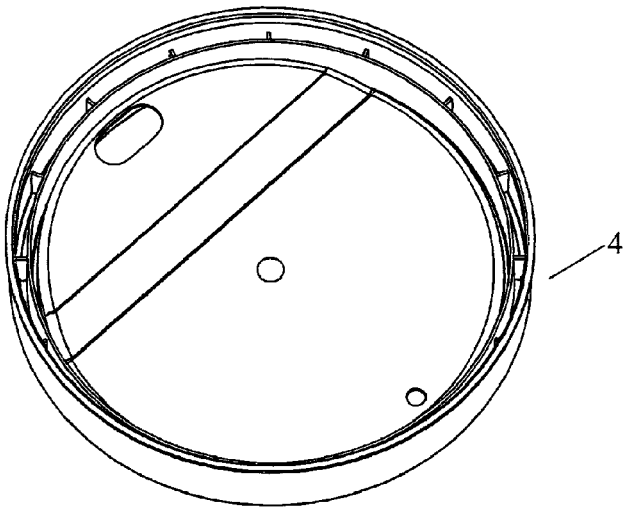
Figure 1J:
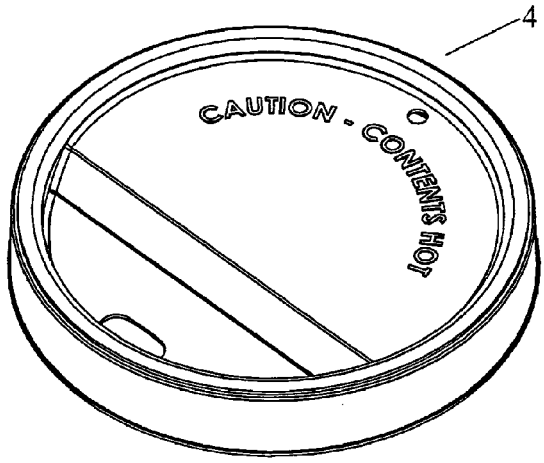
Figure 1F:
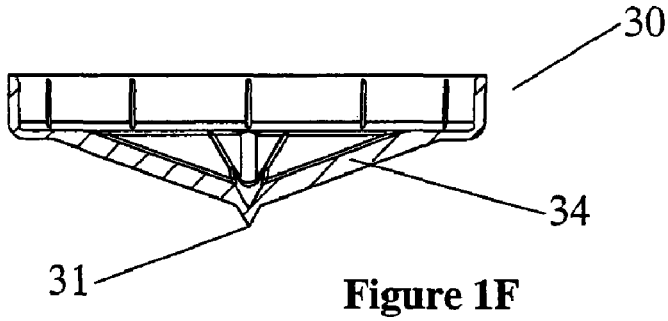
Figure 1G:
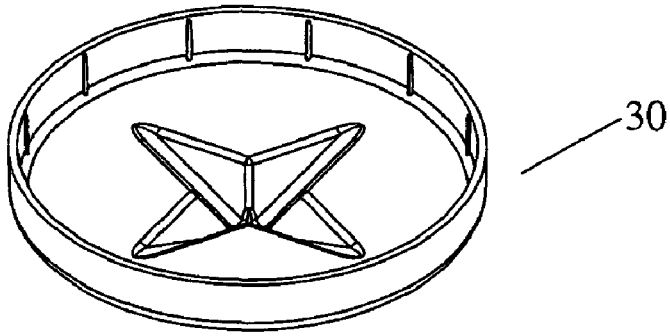
Figure 1H:
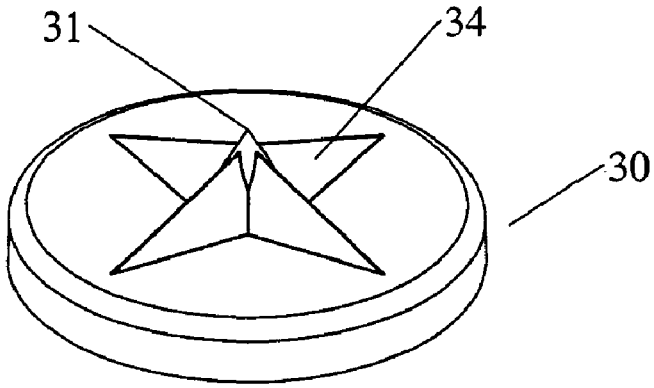
Figure 1M:
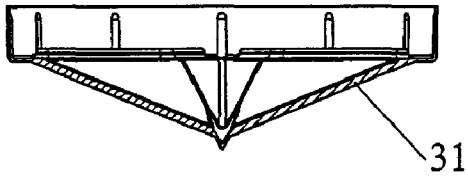
Figure 1K:
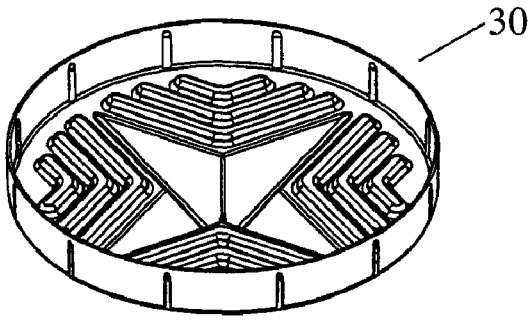
Figure 1L:
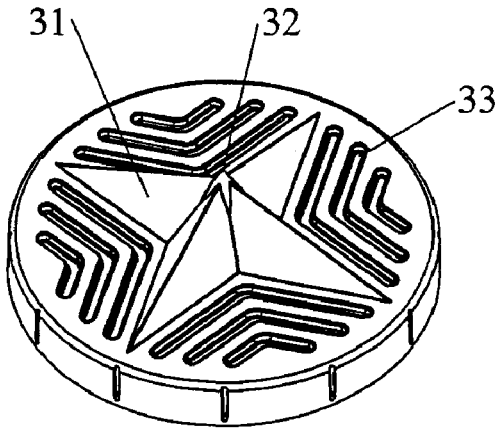
Figure 1N:
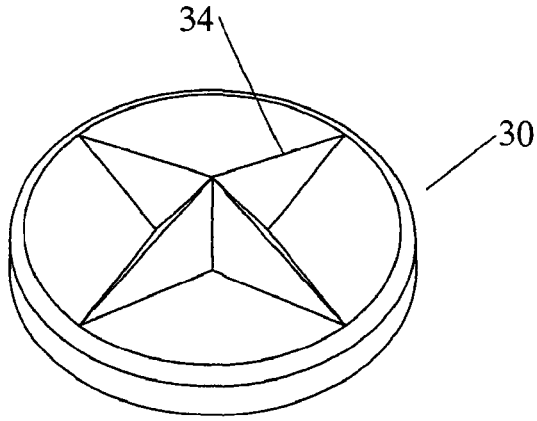
Figure 1O:
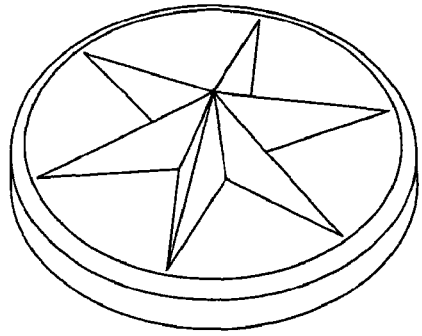
Figure 1P:
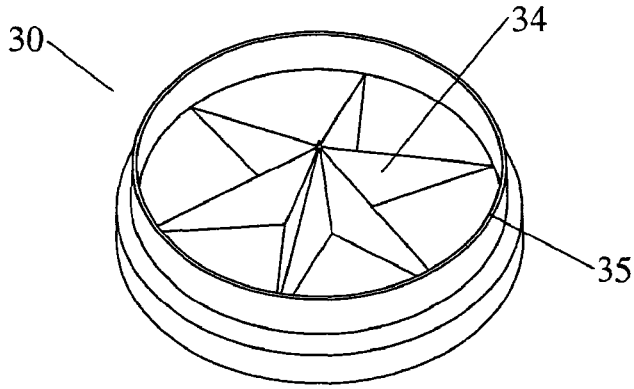
Figure 2:
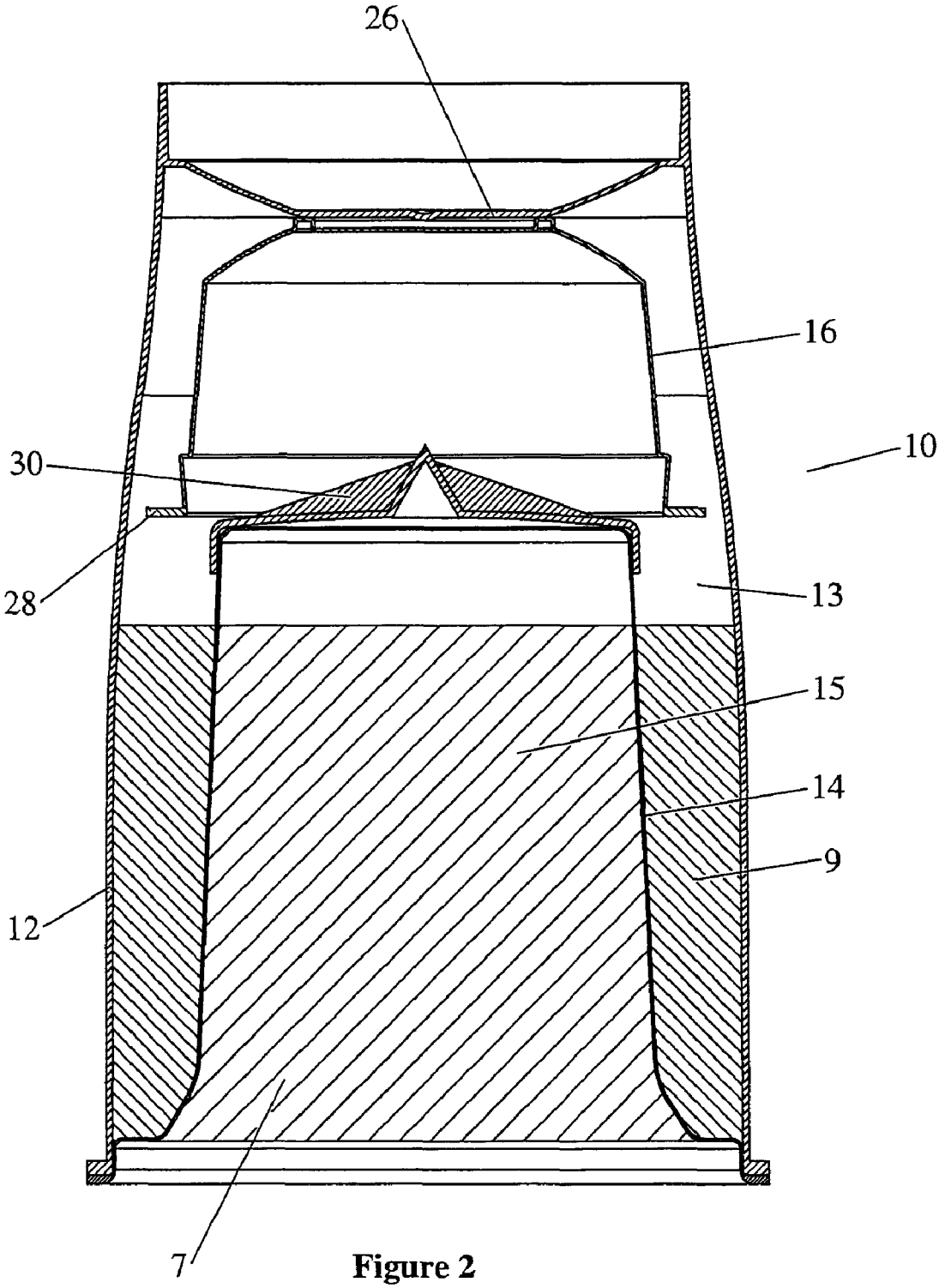
Figure 3A:
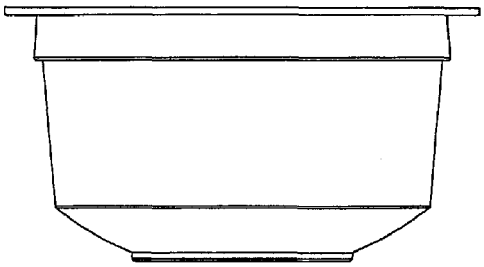
Figure 3B:
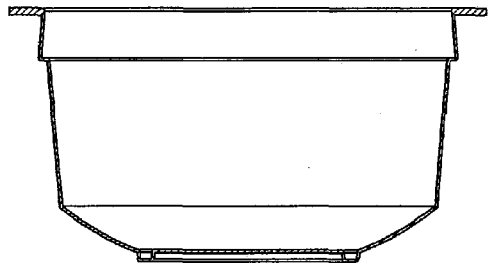
Figure 3C:
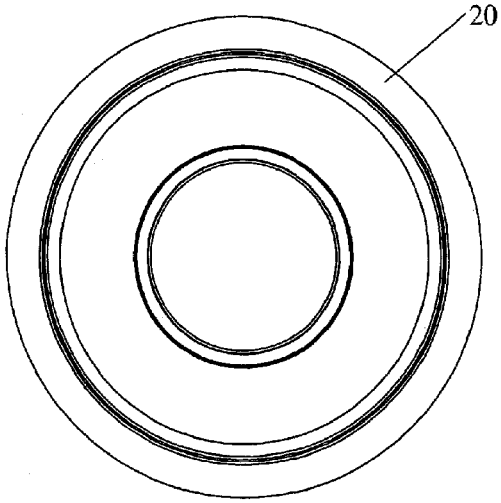
Figure 3D:
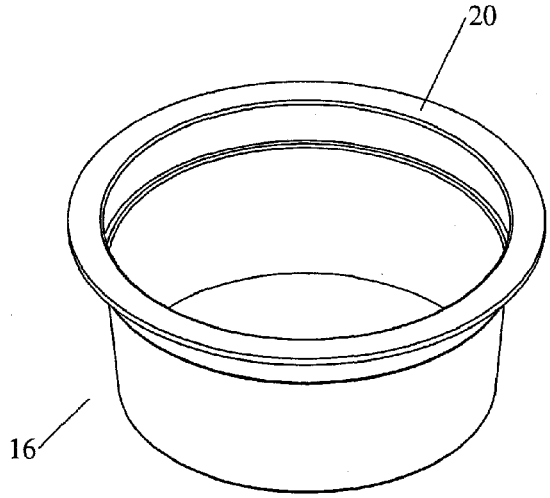
Figure 4:
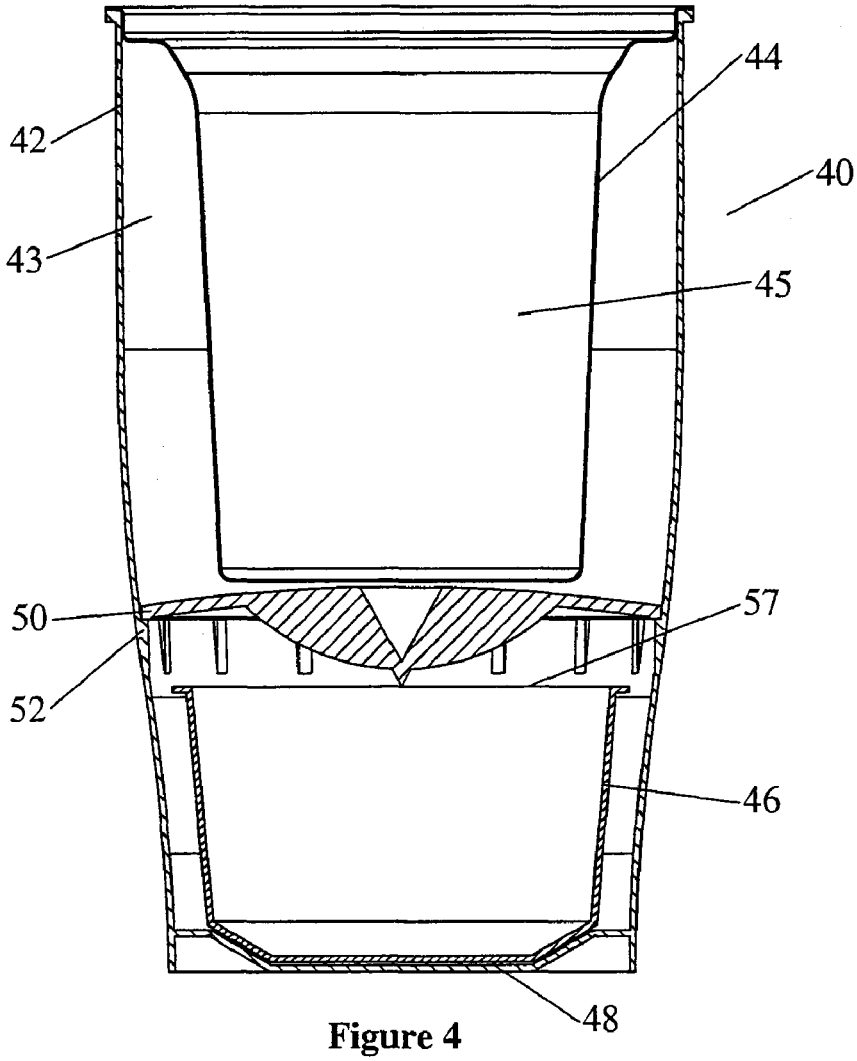
Figure 5:
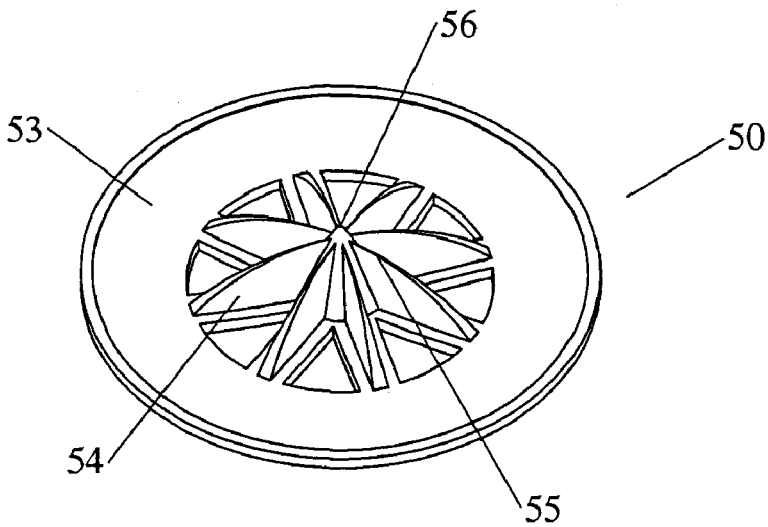
Figure 6:
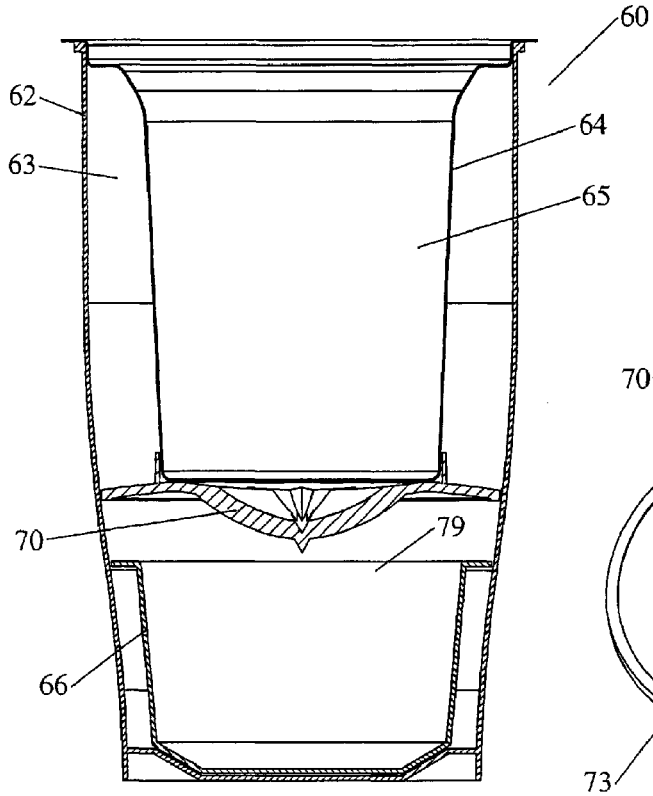
Figure 7A:
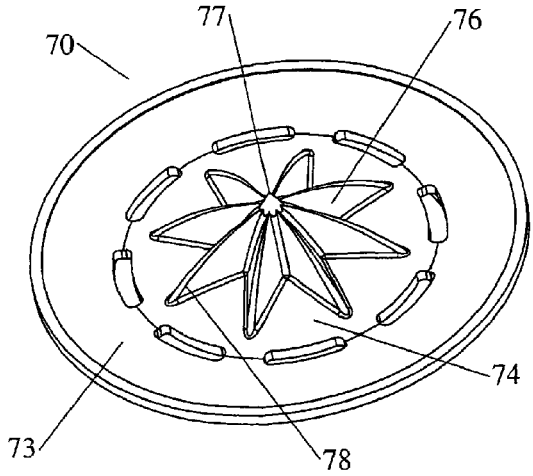
Figure 7B:
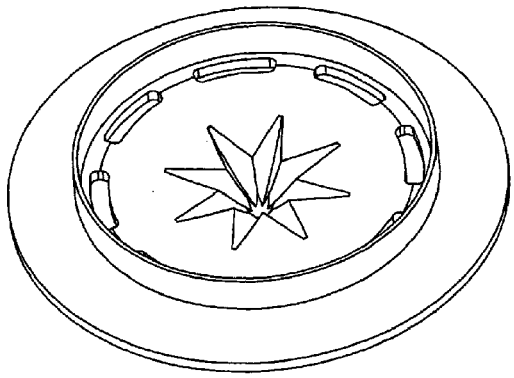
Figure 8:
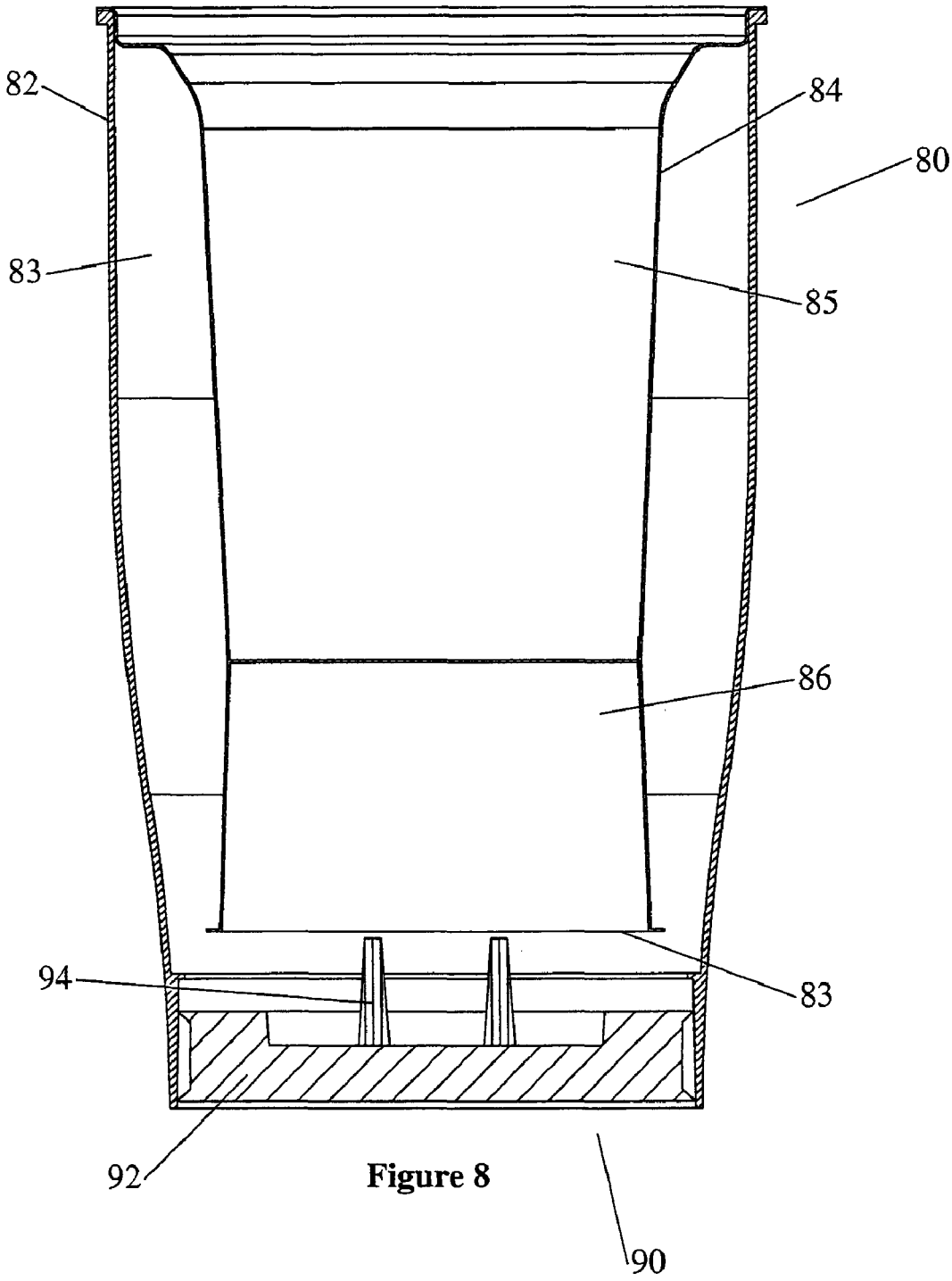
Figure 9:
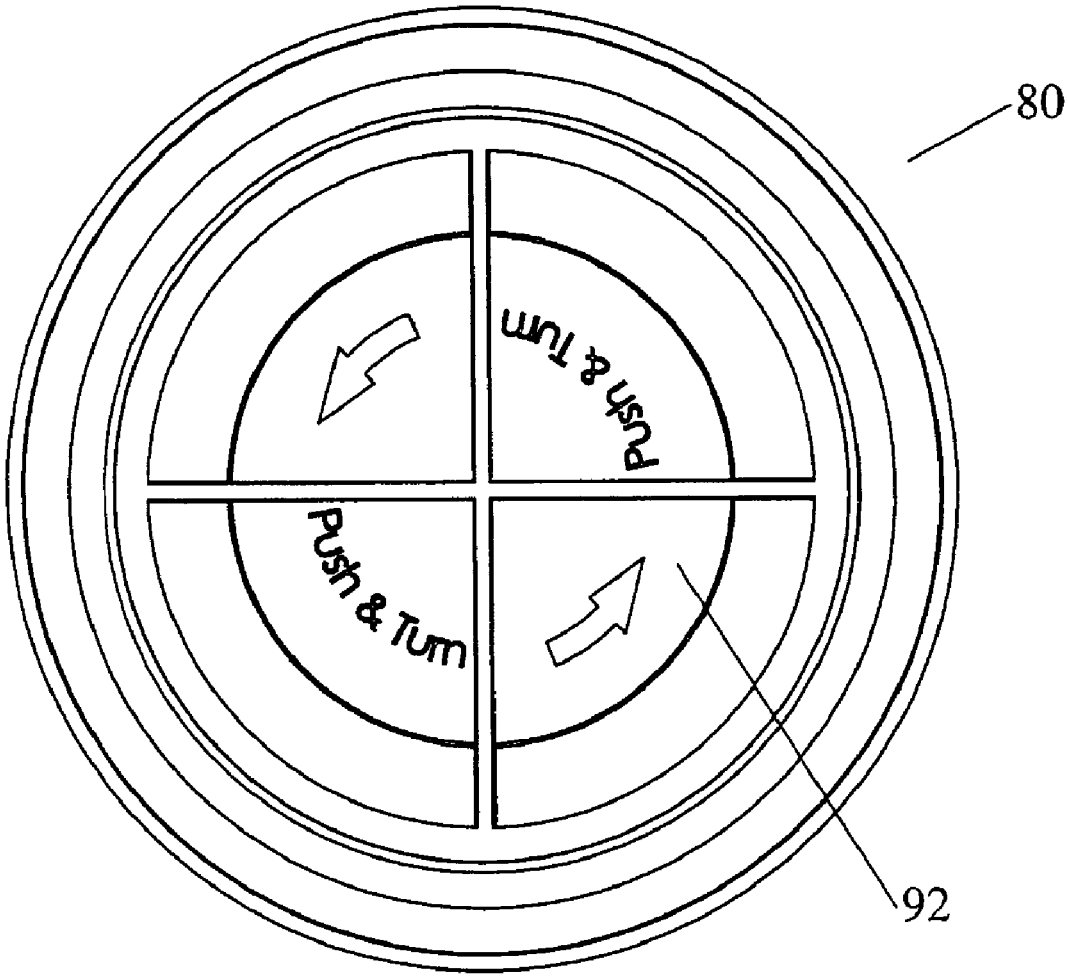
Figure 10:
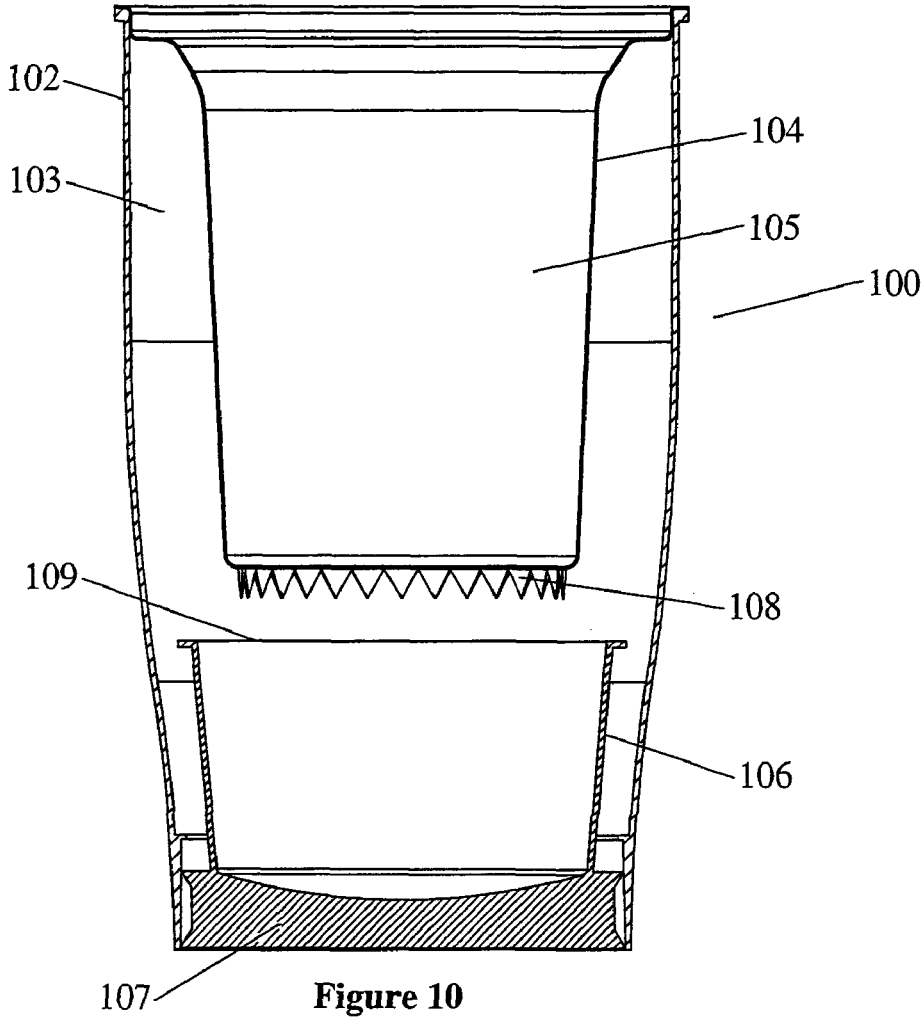
Figure 11:
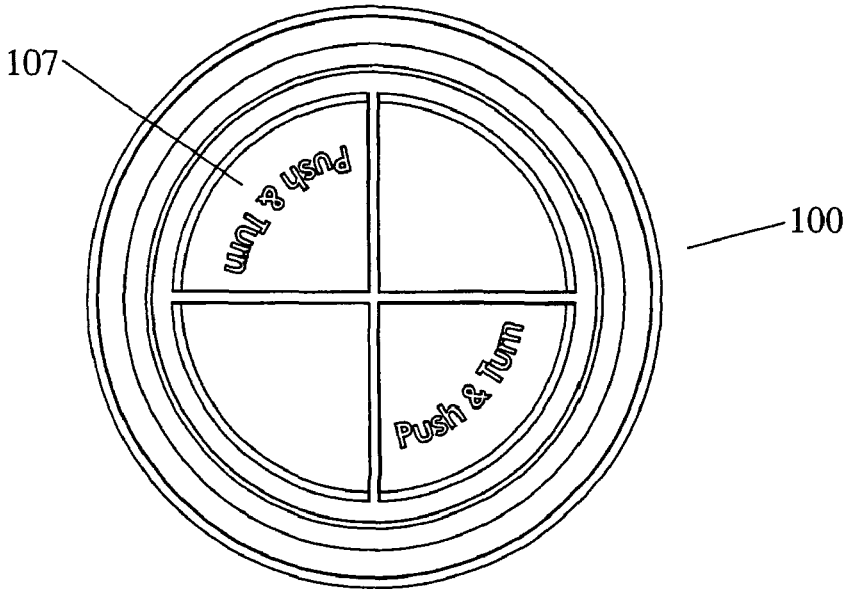
Figure 10A:
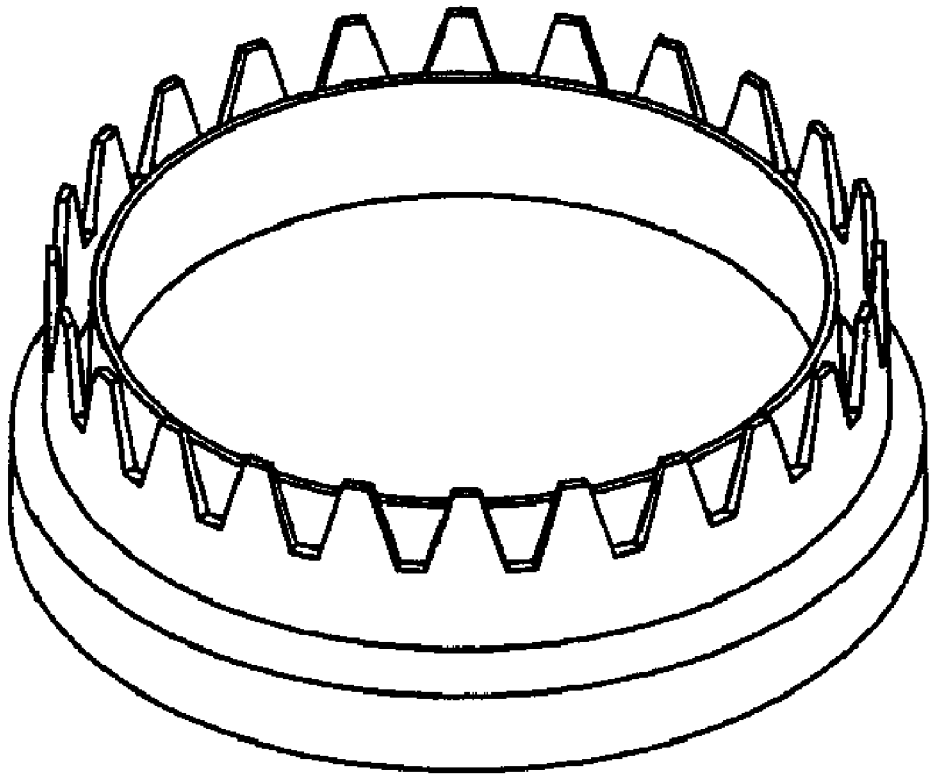
Figure 12A:
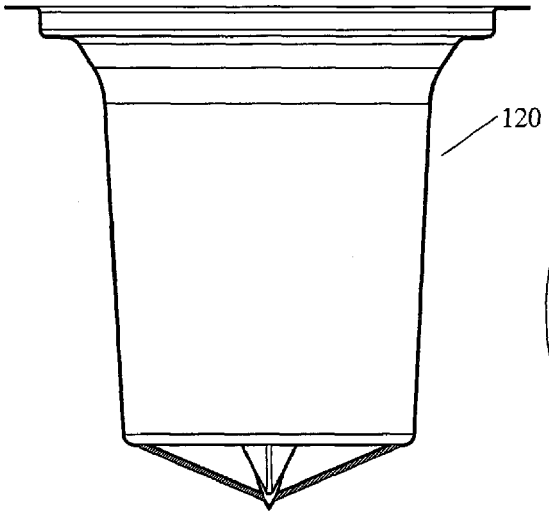
Figure 12B:
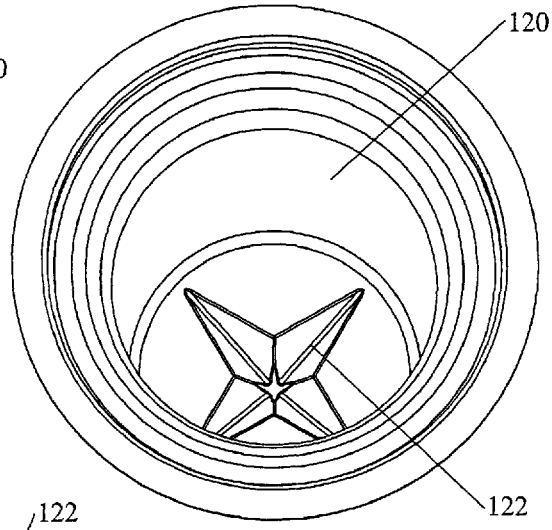
Figure 12C:
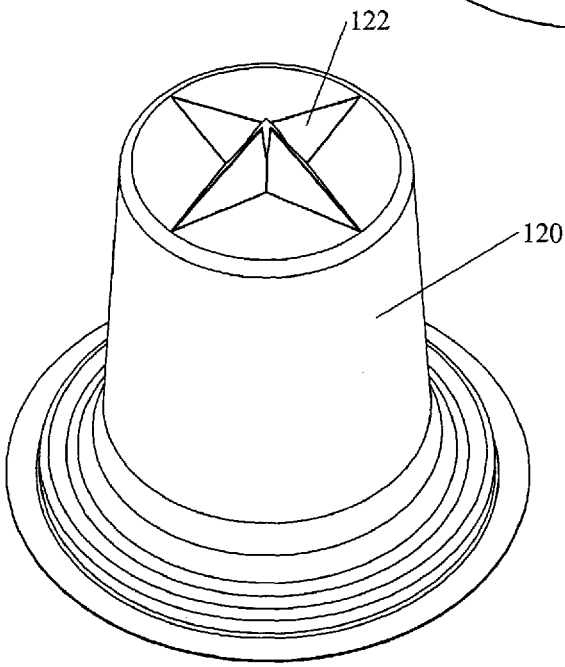
Figure 13A:
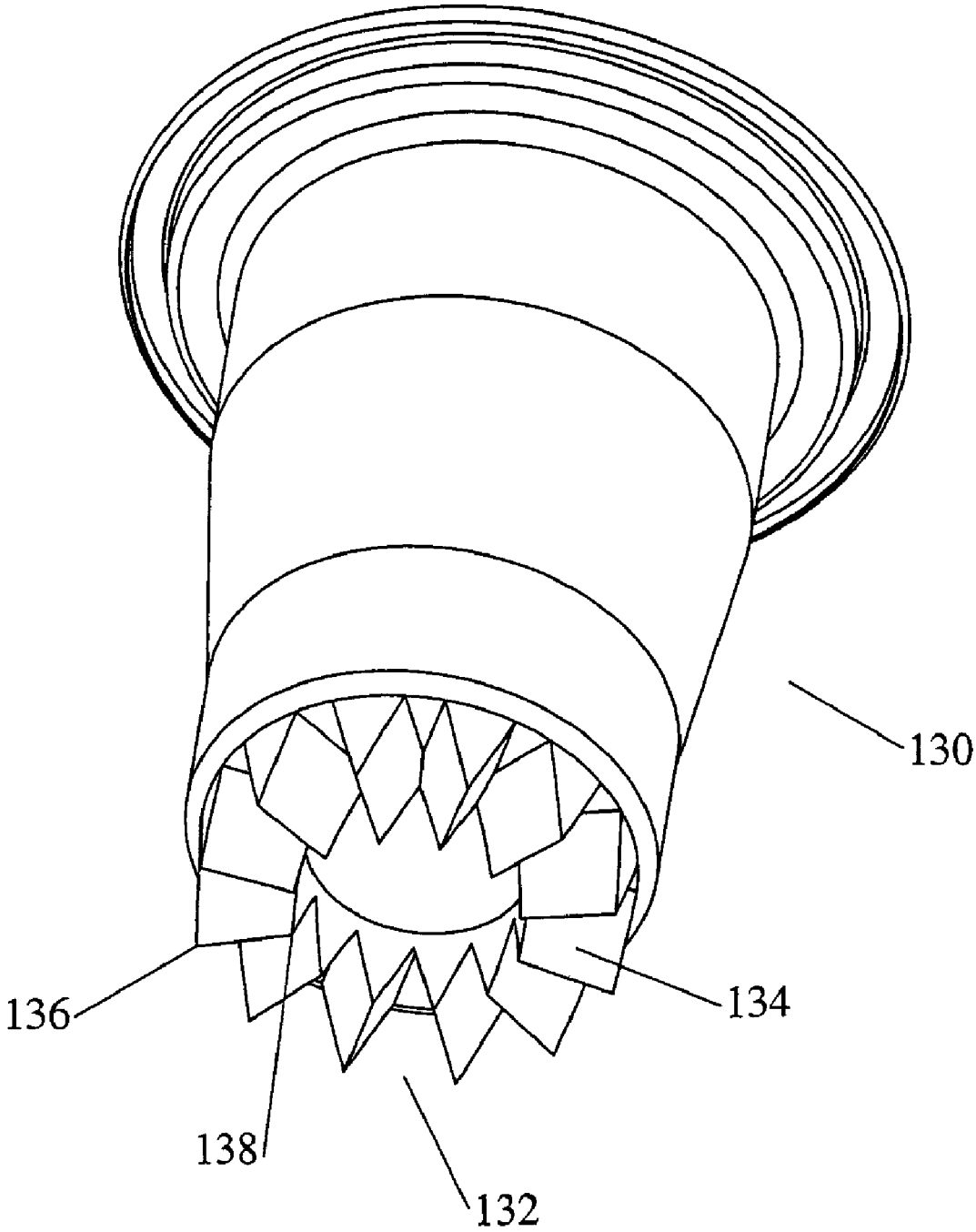
Figures 1, 13A:
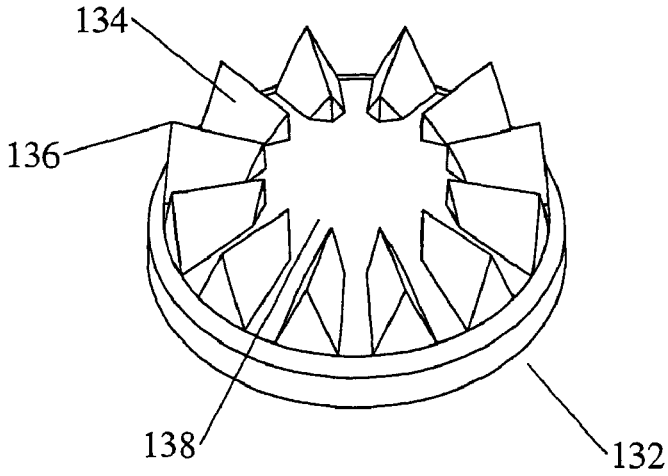
Figures 2, 13A:
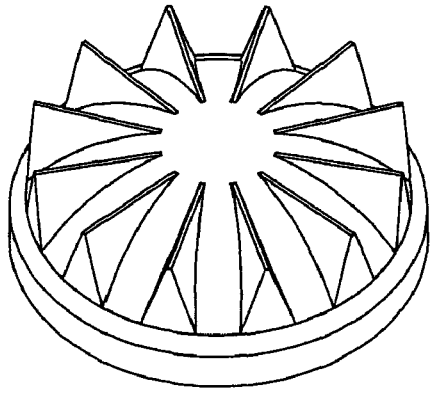
Figures 3, 13A:
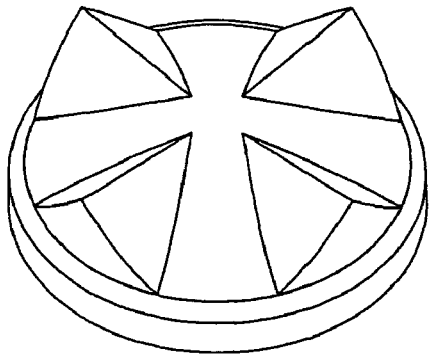
Figures 4, 13A:
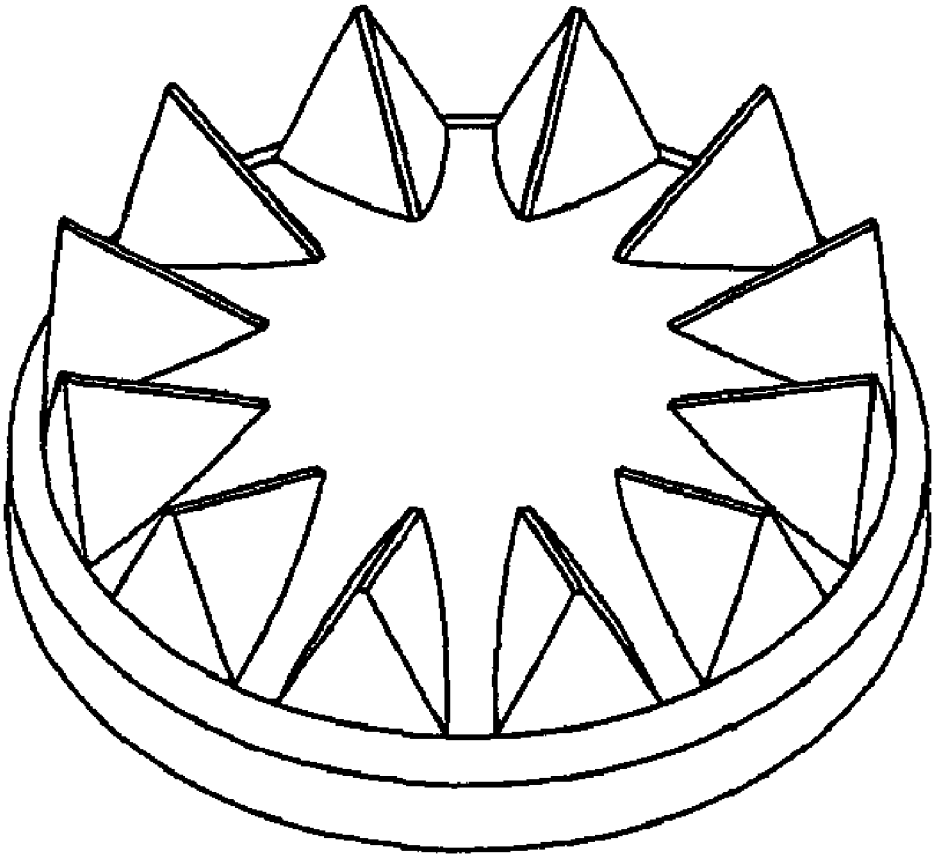
Figure 13B:
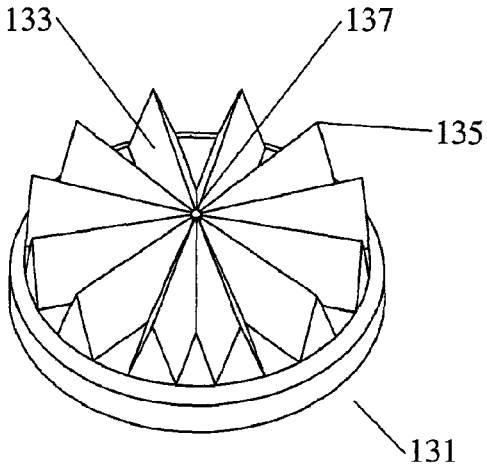
Figure 13C:
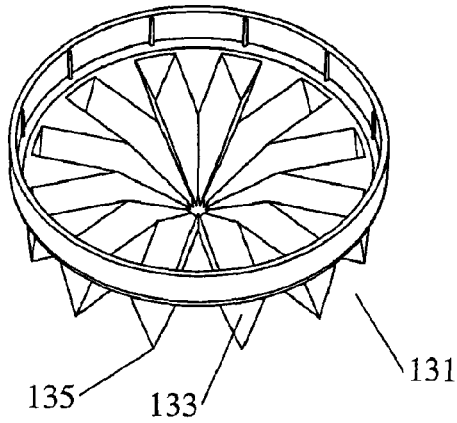
Figure 14A:
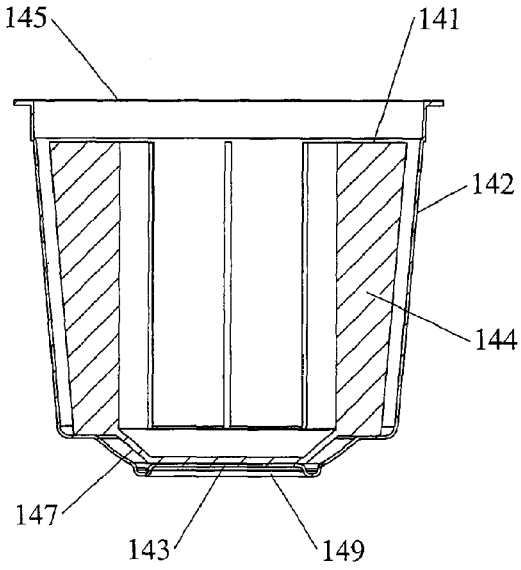
Figure 14B:
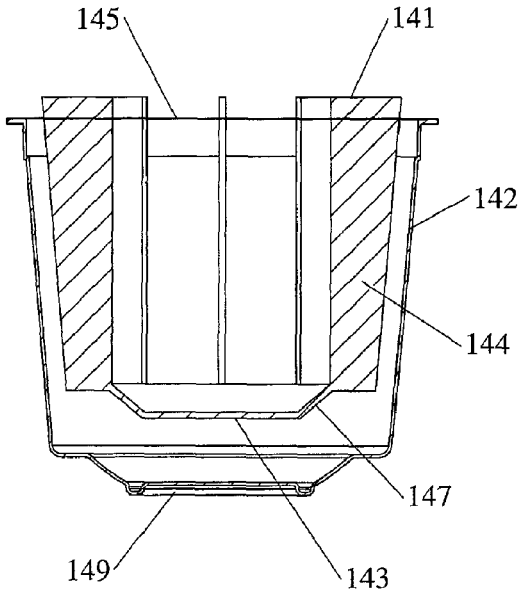
Figure 14C:
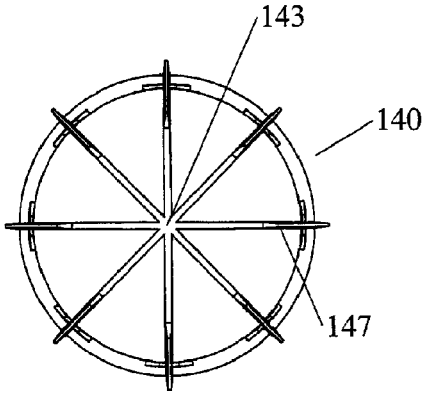
Figure 14D:
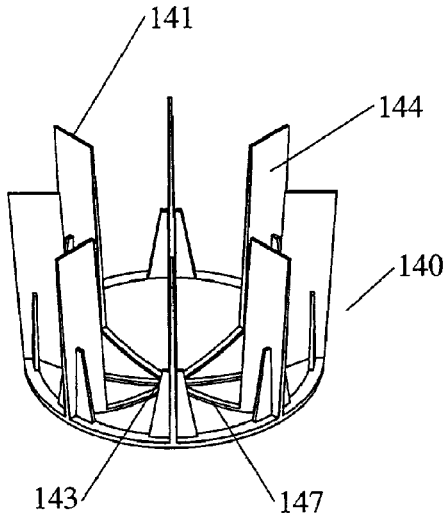
Figure 14E:
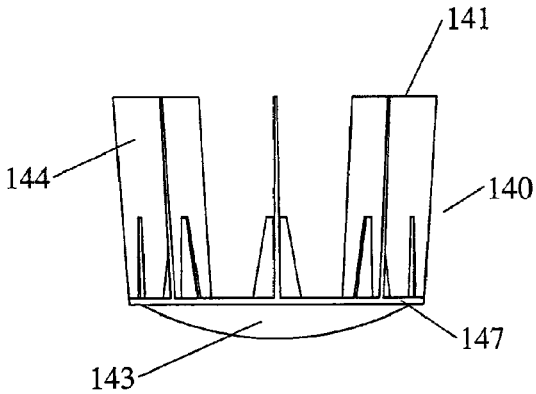
Figure 14F:
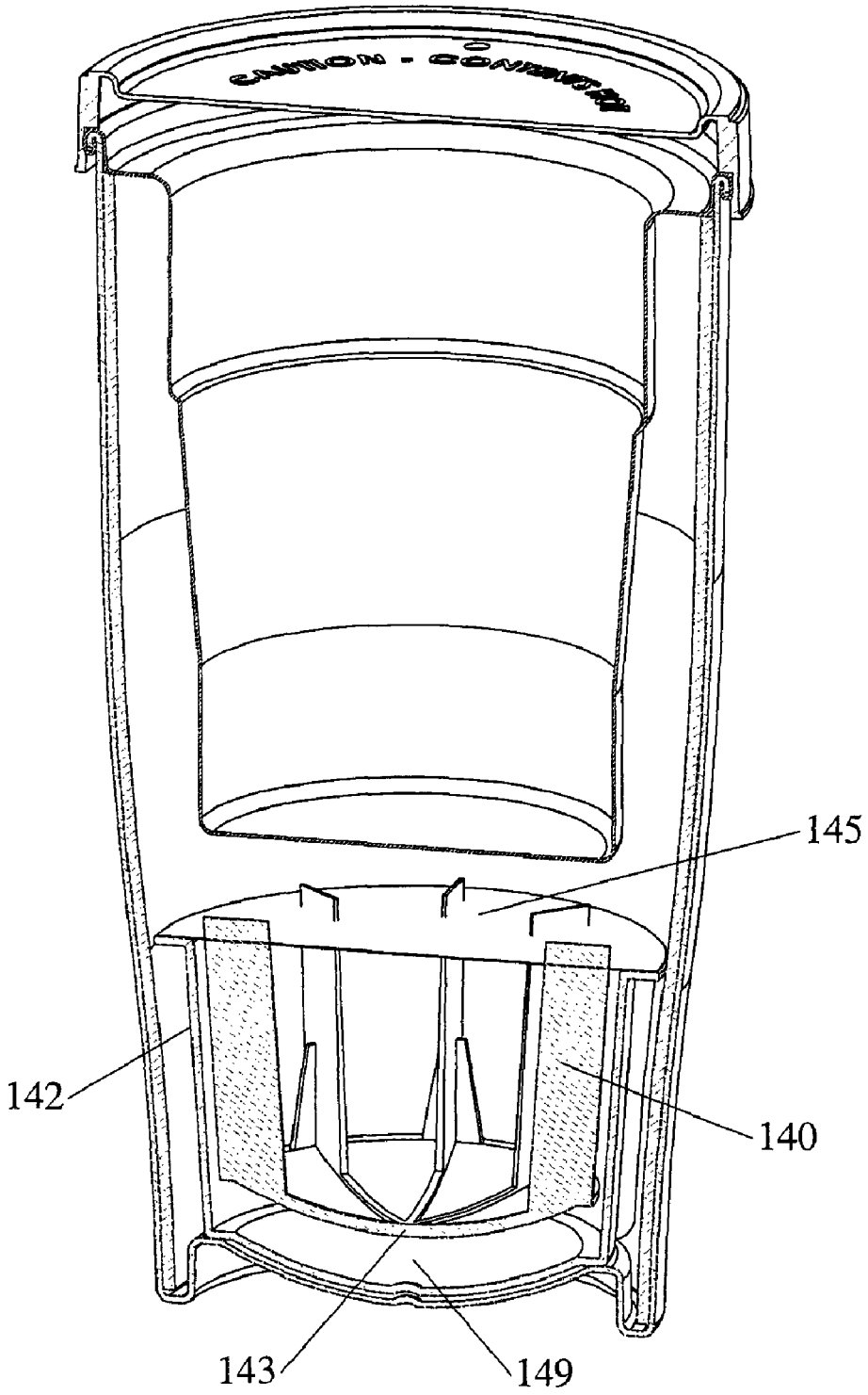
Figure 15:
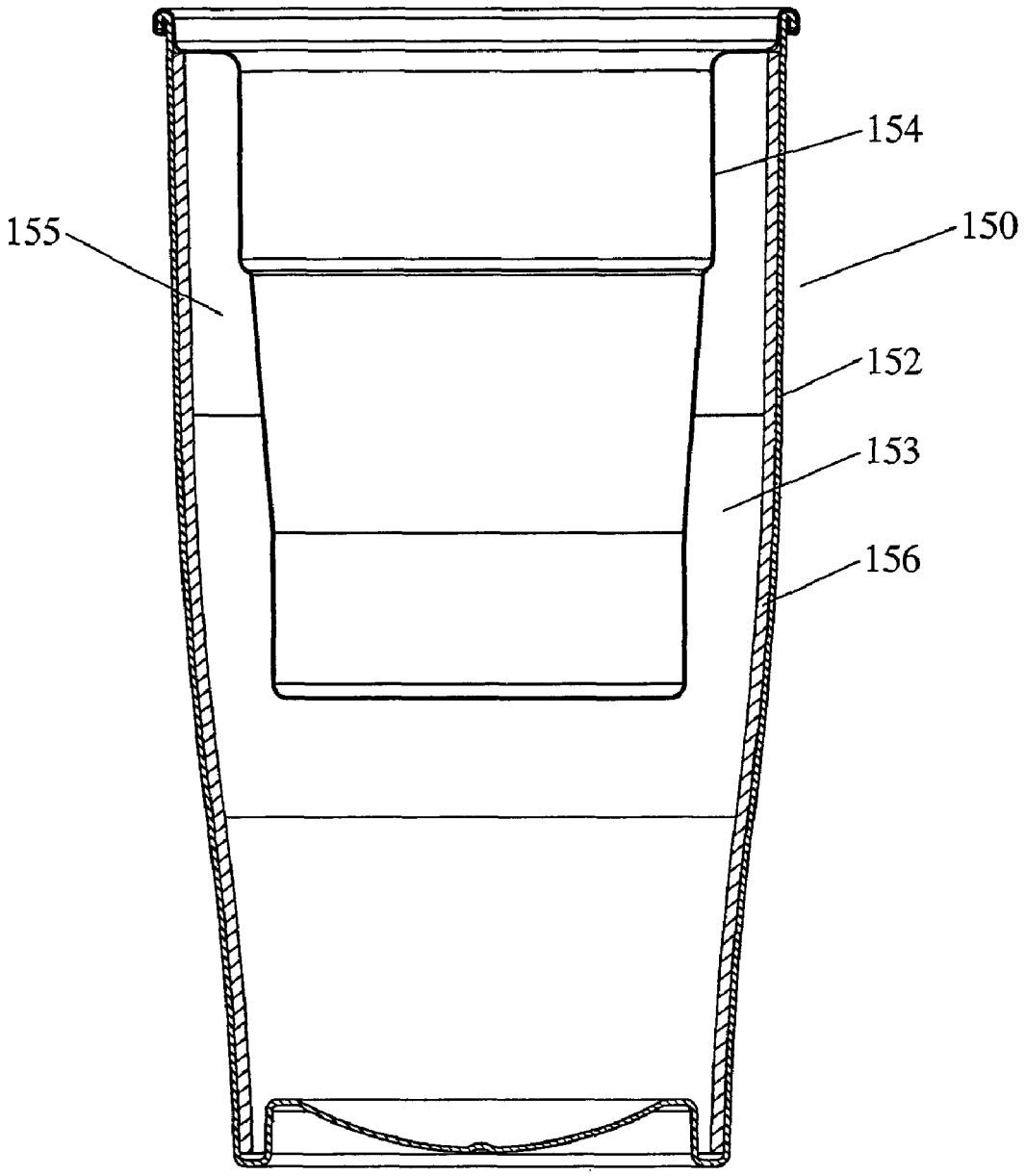
Figure 16A:
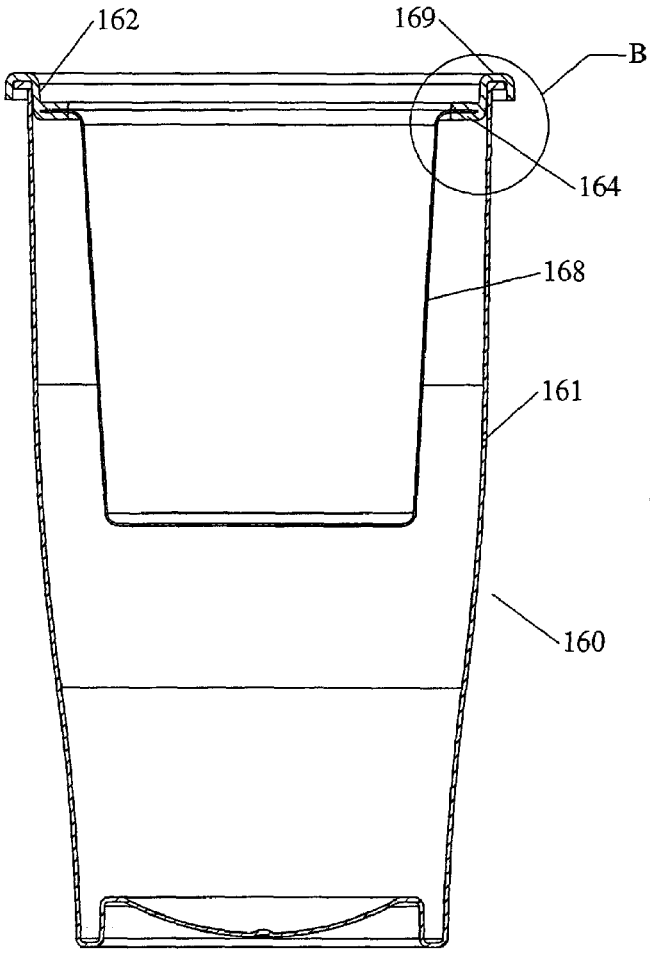
Figure 16B:
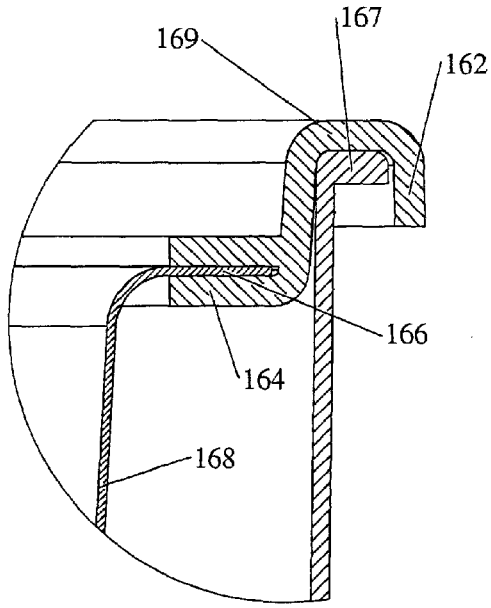
Figure 16C:
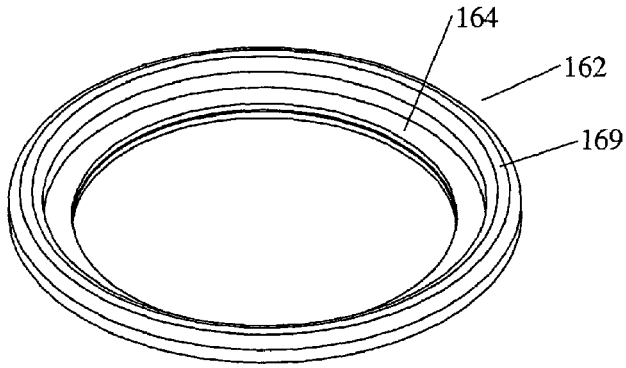
Figure 17A:
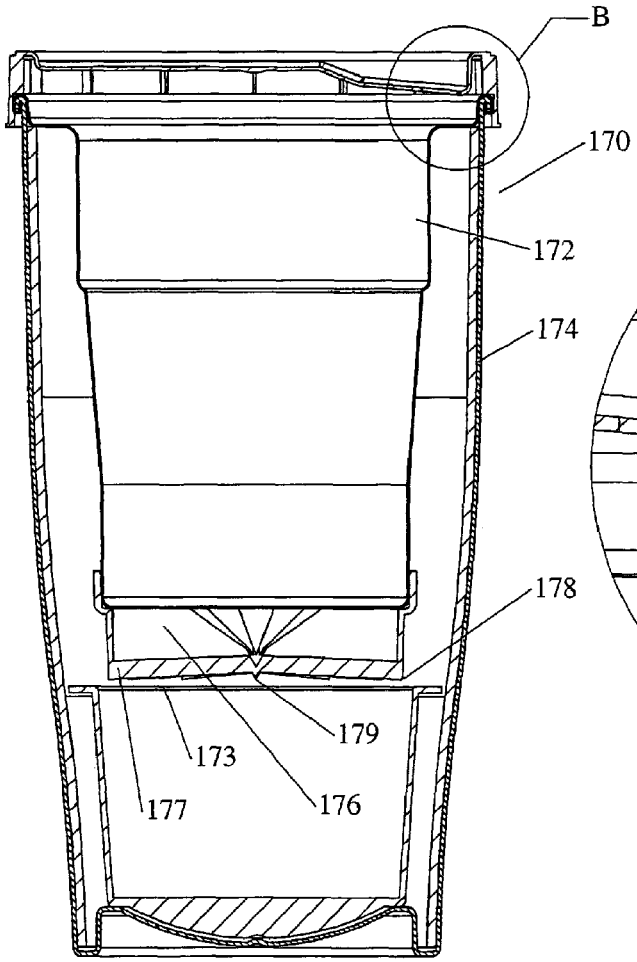

Having thus described the preferred embodiments of the invention in general terms, reference will now be made to the accompanying drawings, which are not necessarily drawn to scale, and wherein:

FIG. 1A is a cross-sectional view of a container prior to activation of the self-heating step according to one embodiment of the present invention;

FIG. 1B shows a perspective view of the container of FIG. 1A according to one embodiment of the present invention;

FIG. 1C shows a bottom view of the container of FIG. 1A according to one embodiment of the present invention;

FIG. 1D shows a cross-sectional view of a container according to another embodiment of the present invention;

FIG. 1E shows a top view of a pull tab lid according to one embodiment of the present invention;

FIG. 1F shows a cross-sectional view of a breaking device of the container of FIG. 1A according to one embodiment of the present invention;

FIG. 1G shows a top view of a breaking device of the container of FIG. 1A according to one embodiment of the present invention;

FIG. 1H shows a bottom view of the breaking device of the container of FIG. 1A according to one embodiment of the present invention;

FIG. 1I shows a bottom view of a drinking lid of the container of FIG. 1A according to one embodiment of the present invention;

FIG. 1J shows a top view of a drinking lid of the container of FIG. 1A according to one embodiment of the present invention;

FIG. 1K shows a top view of a breaking device according to one embodiment of the present invention;

FIG. 1L shows a bottom view of the breaking device of FIG. 1K according to one embodiment of the present invention;

FIG. 1M shows a cross-sectional view of the breaking device of FIG. 1K according to one embodiment of the present invention;

FIG. 1N shows a bottom view of a breaking device according to one embodiment of the present invention;

FIG. 1O shows a bottom view of a breaking device according to one embodiment of the present invention;

FIG. 1P shows a bottom view of a breaking device according to one embodiment of the present invention;

FIG. 2 is an up-side-down cross-sectional view of the container of FIG. 1A prior to the self-heating step according to one embodiment of the present invention;

FIG. 3A is a cross-sectional view of a reactant vessel according to one embodiment of the present invention;

FIG. 3B is a cross-sectional view of a reactant vessel according to one embodiment of the present invention;

FIG. 3C is a top view of the reactant vessel of FIG. 3A according to one embodiment of the present invention;

FIG. 3D is a perspective view of the reactant vessel of FIG. 3A according to one embodiment of the present invention;

FIG. 4 is a cross-sectional view of a container prior to activation of the self-heating step according to yet another embodiment of the present invention;

FIG. 5 is a bottom view of the breaking device included in the container of FIG. 4 according to one embodiment of the present invention;

FIG. 6 is a cross-sectional view of a container prior to activation of the self-heating step according to an alternative embodiment of the present invention;

FIG. 7A is a bottom view of the breaking device included in the container of FIG. 6 according to one embodiment of the present invention;

FIG. 7B is a top view of the breaking device included in the container of FIG. 6 according to one embodiment of the present invention;

FIG. 8 is a cross-sectional view of a container prior to activation of the self-heating step according to another embodiment of the present invention;

FIG. 9 is a bottom view of the container of FIG. 8 according to one embodiment of the present invention;

FIG. 10 is a cross-sectional view of a container prior to activation of the self-heating step according to an additional embodiment of the present invention;

FIG. 10A shows a bottom view of the breaking device of FIG. 10 according to one embodiment of the present invention;

FIG. 11 is a bottom view of the container of FIG. 10 according to one embodiment of the present invention;

FIG. 12A shows a cross-sectional view of the inner container body according to one embodiment of the present invention;

FIG. 12B shows a top view of the inner container body of FIG. 12A according to one embodiment of the present invention;

FIG. 12C shows a bottom view of the inner container body of FIG. 12A according to one embodiment of the present invention;

FIG. 13A is a perspective view of an inner container body according to one embodiment of the present invention;

FIGS. 13A-1 is a bottom view of the breaking device according to one embodiment of the present invention;

FIGS. 13A-2 is a bottom view of the breaking device according to another embodiment of the present invention;

FIGS. 13A-3 is a bottom view of the breaking device according to yet another embodiment of the present invention;

FIGS. 13A-4 is a bottom view of the breaking device according to an alternative embodiment of the present invention;

FIG. 13B is a bottom, perspective view of the breaking device according to one embodiment of the present invention;

FIG. 13C is a top, perspective view of the breaking device of FIG. 13B according to one embodiment of the present invention;

FIG. 14A is a cross-sectional view of the reactant vessel containing a breaking device prior to activation of the self-heating step according to one embodiment of the present invention;

FIG. 14B is a cross-sectional view of the reactant vessel of FIG. 14A after activation according to one embodiment of the present invention;

FIG. 14C is a bottom view of the breaking device of FIG. 14A according to one embodiment of the present invention;

FIG. 14D is a perspective view of the breaking device of FIG. 14A according to one embodiment of the present invention;

FIG. 14E is a cross sectional view of the breaking device of FIG. 14A according to one embodiment of the present invention;

FIG. 14F is a cut out perspective view of a self-heating container which includes the reactant vessel and the breaking device of FIG. 14A according to an embodiment of the present invention;

FIG. 15 is a cross-sectional view of a portion of a container according to an embodiment of the present invention;

FIG. 16A is a cross-sectional view of the container according to one embodiment of the present invention;

FIG. 16B is a detailed view of the area B of the container of FIG. 16A according to one embodiment of the present invention;

FIG. 16C is a perspective view of the lip shown in FIG. 16A according to one embodiment of the present invention;

FIG. 17A is a cross-sectional view of a container according to one embodiment of the present invention.

Figure 17B:
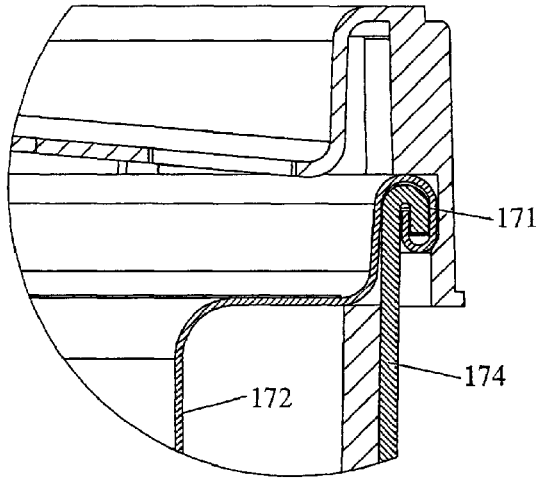
Figure 18A:
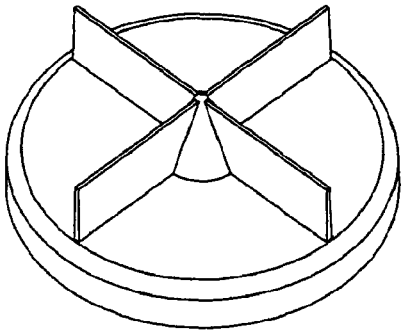
Figure 18B:
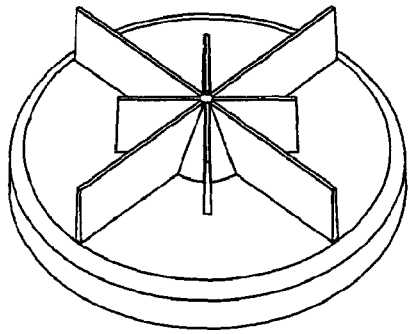
Figure 18C:
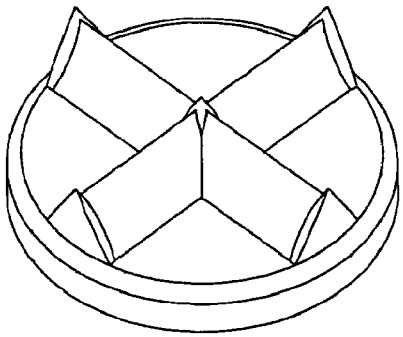
Figure 18D:
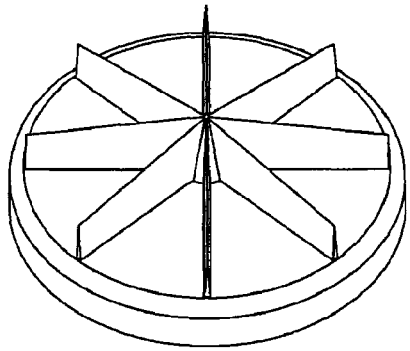
Figure 19:
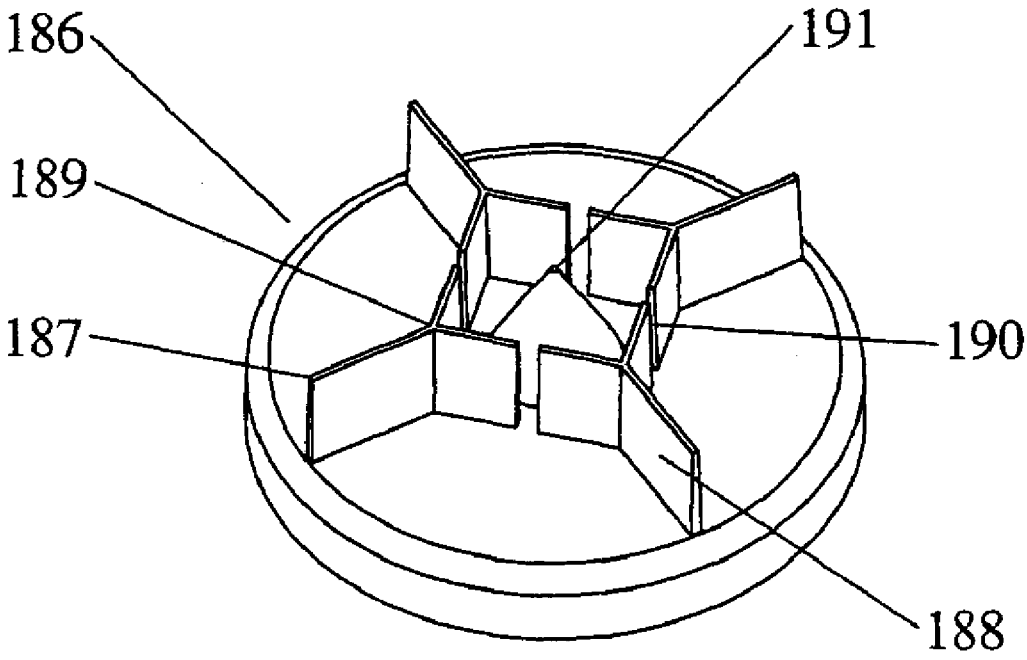
Figure 20A:
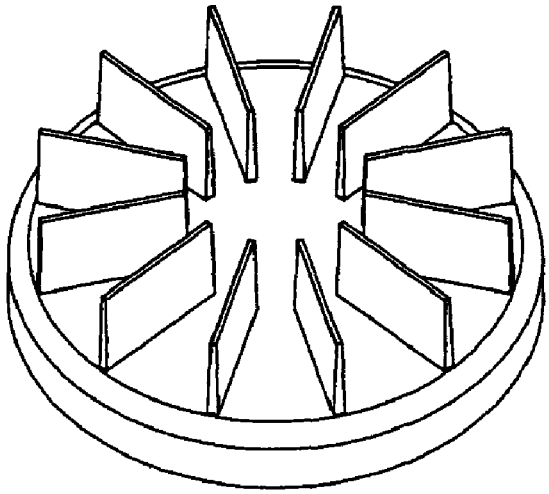
Figure 20B:
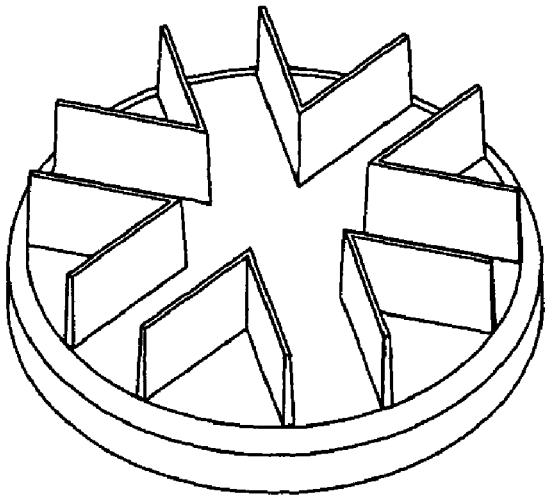
Figure 21:
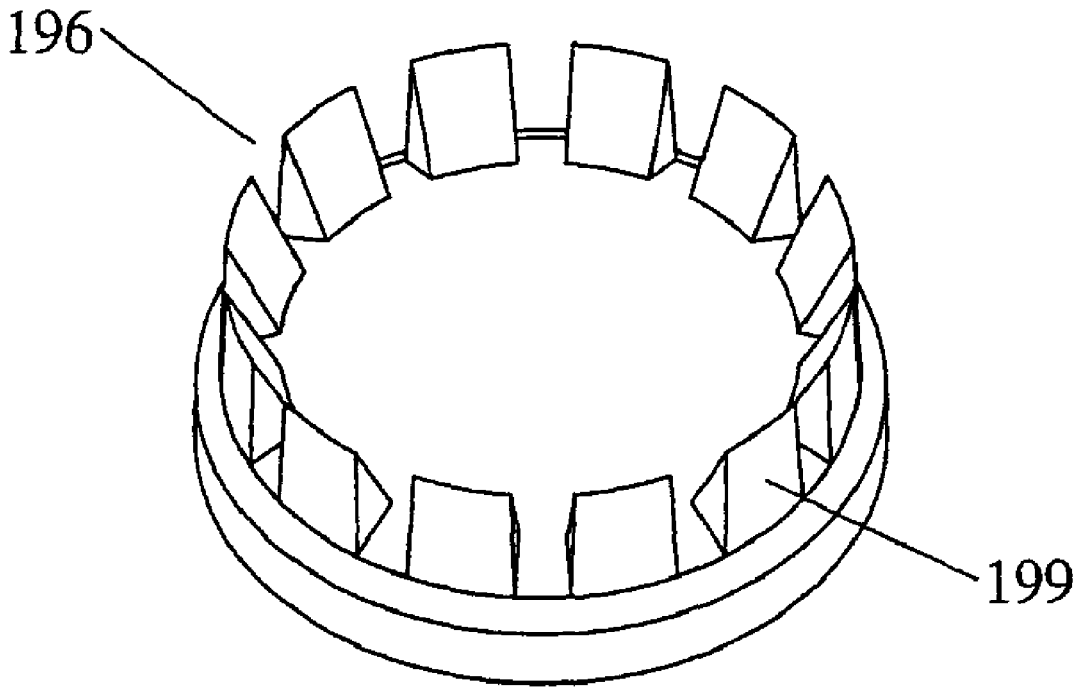
Figure 22A:
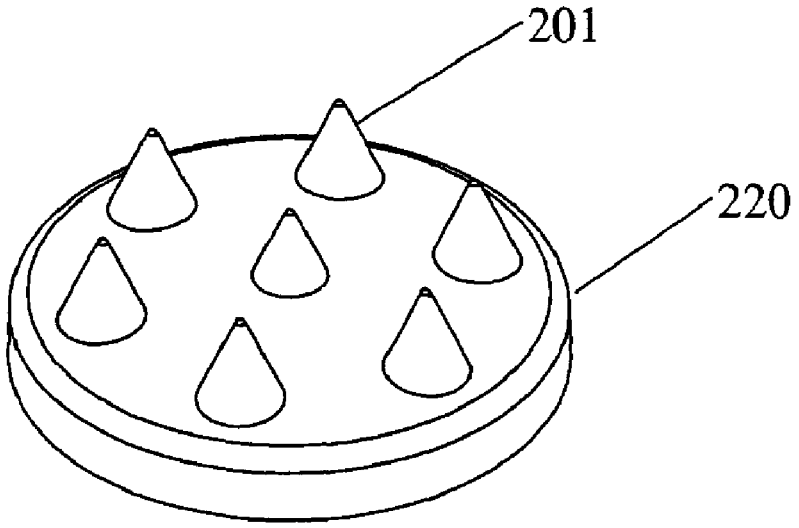
Figure 22B:
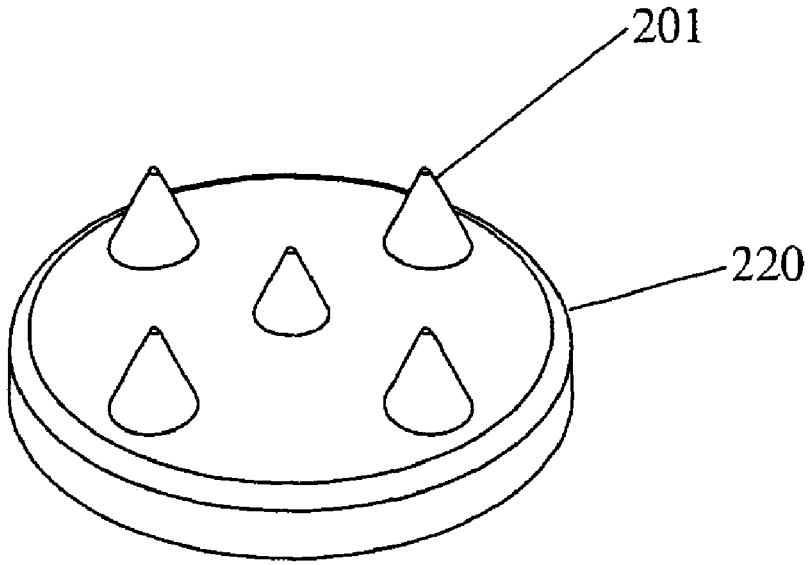
Figure 22C:
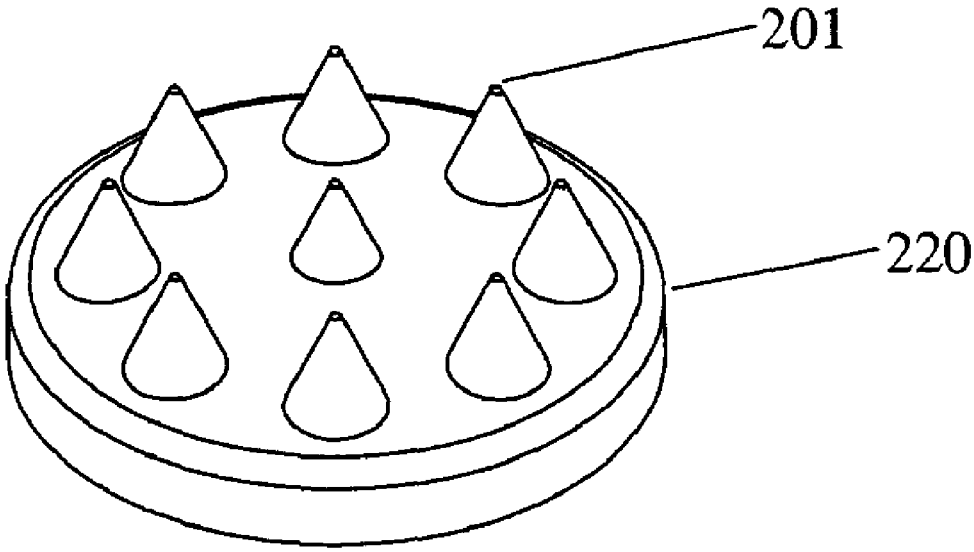
Figure 23A:
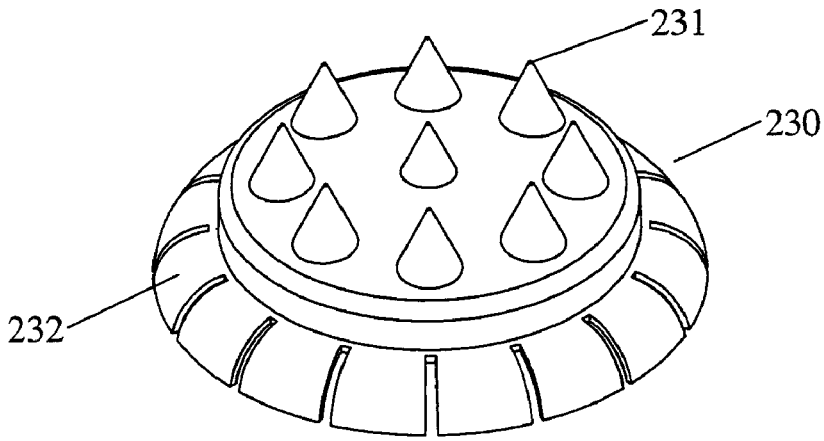
Figure 23B:
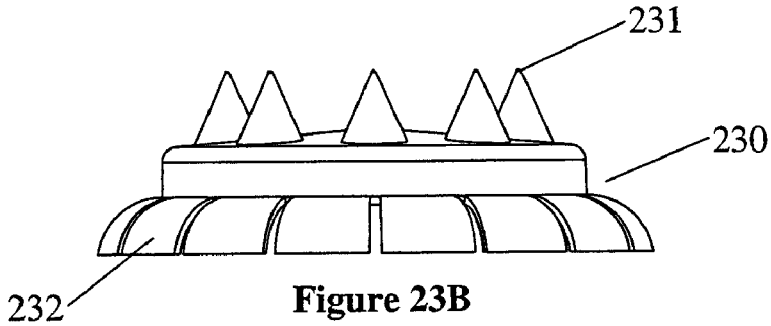
Figure 23C:
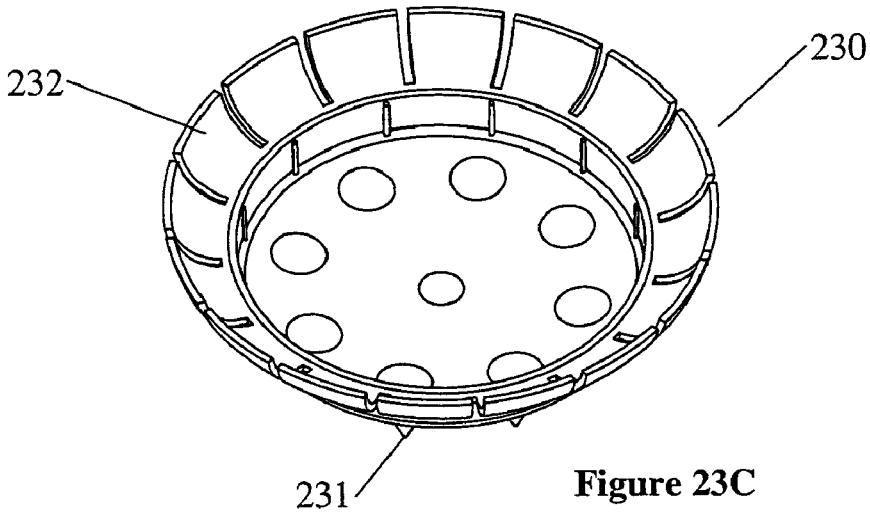
Figure 23D:
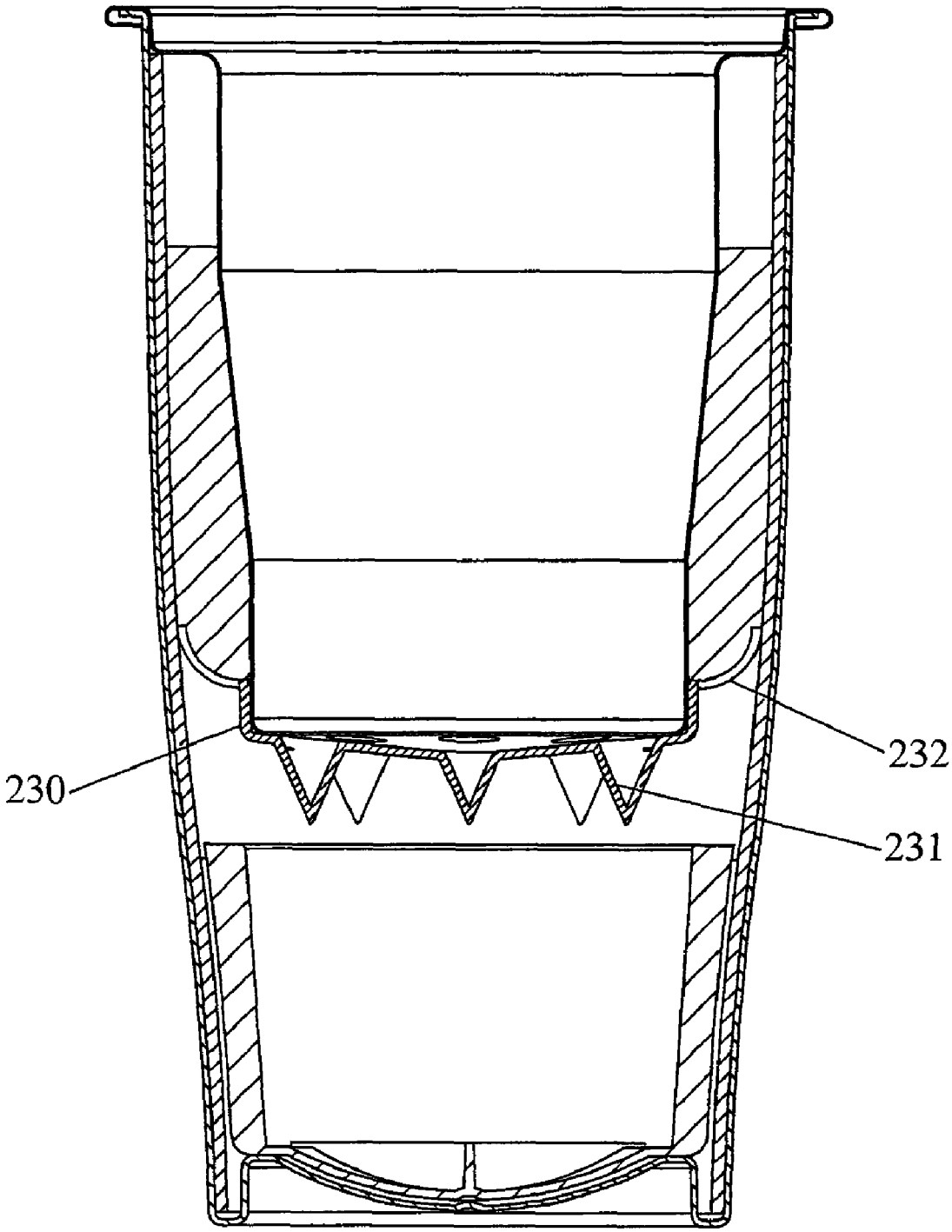
Figure 23E:
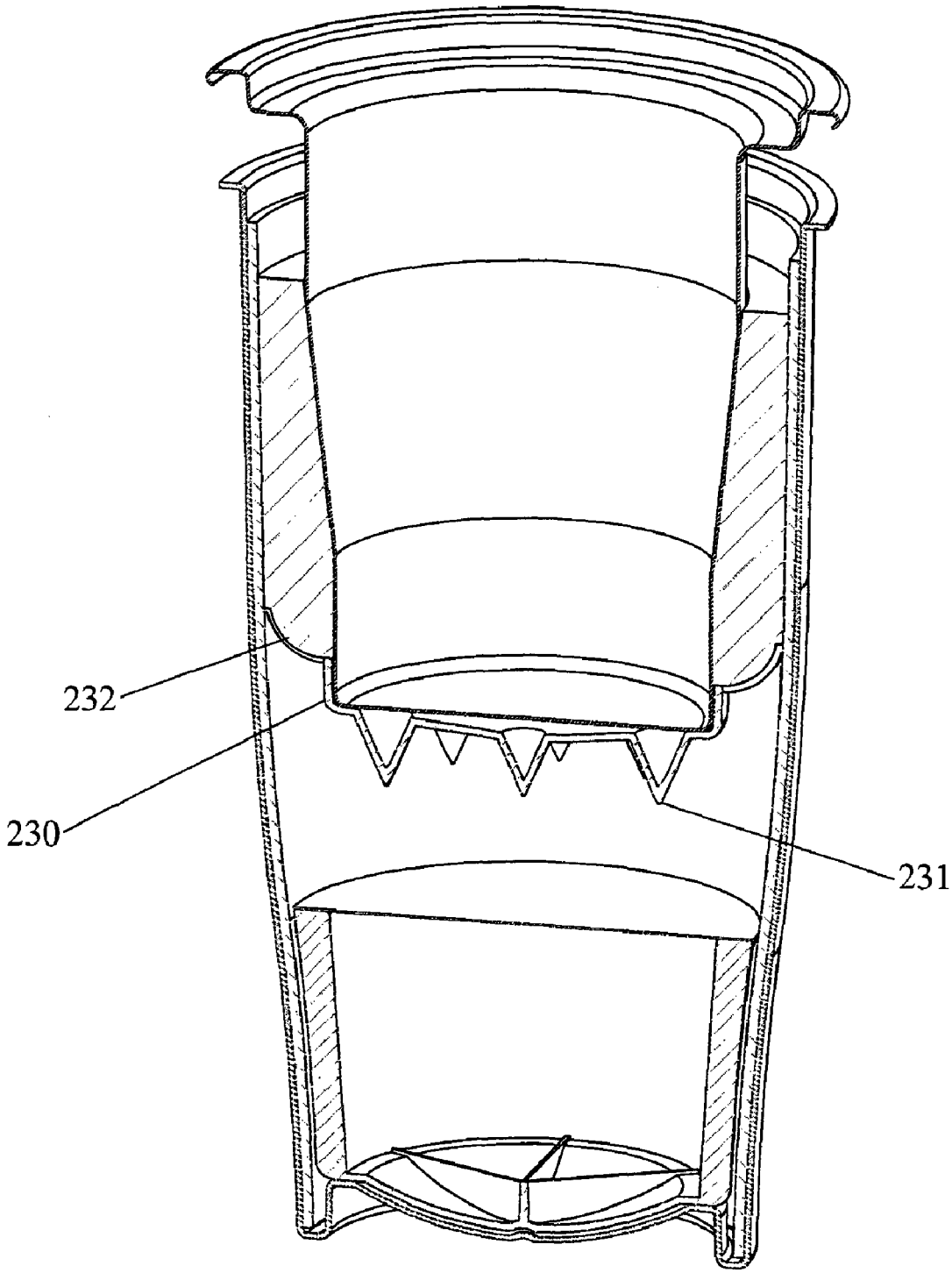

FIG. 17B is a detailed view of the area B of the container of FIG. 17A according to one embodiment of the present invention;

FIG. 18A is a bottom view of the breaking device according to one embodiment of the present invention;

FIG. 18B is a bottom view of the breaking device according to one embodiment of the present invention;

FIG. 18C is a bottom view of the breaking device according to one embodiment of the present invention;

FIG. 18D is a bottom view of the breaking device according to one embodiment of the present invention;

FIG. 19 is a bottom view of the breaking device according to one embodiment of the present invention;

FIG. 20A is a bottom view of the breaking device according to one embodiment of the present invention;

FIG. 20B is a bottom view of the breaking device according to one embodiment of the present invention;

FIG. 21 is a bottom view of the breaking device according to one embodiment of the present invention;

FIG. 22A provides a bottom view of the breaking device according to one embodiment of the present invention;

FIG. 22B provides a bottom view of the breaking device according to one embodiment of the present invention;

FIG. 22C provides a bottom view of the breaking device according to one embodiment of the present invention;

FIG. 23A is a bottom view of the breaking device according to one embodiment of the present invention;

FIG. 23B is a front view of the breaking device in an inverted position according to one embodiment of the present invention;

FIG. 23C is a bottom view of the breaking device in an inverted position according to one embodiment of the present invention;

FIG. 23D is a cross-sectional view of a self-heating container with the breaking device in FIGS. 23A-C according to one embodiment of the present invention; and FIG. 23E is a cut-out perspective view of the self-heating container in FIG. 23D according to one embodiment of the present invention.

DETAILED DESCRIPTION OF THE PREFERRED EMBODIMENTS

The preferred embodiments of the present invention will now be described more fully hereinafter with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

Referring to FIG. 1A, in one embodiment of the present invention, a container 10 includes an outer container body 12 defining a first chamber 13, an inner container body 14 defining a second chamber 15 disposed within the outer container body 12, and a reactant vessel 16 disposed within the first chamber 13. The inner container body 14 holds the beverage, food item, or any other consumable products or substance to be heated. A lid 2 covering the inner container body 14 is used to keep the substance inside the second chamber 15. In a preferred embodiment, the inner container body 14 is constructed with a material having high thermal conductivity. For example, the inner container body 14 can be constructed of a metallic material such as aluminum or certain polymeric material such as polyolefin. In a preferred embodiment, the second chamber 15 defined within the inner container body 14 is of such a size as to hold a liquid capacity of greater than 100 mL and in a more preferred embodiment, liquid capacity of greater than 200 mL. The inner container body 14 and the outer container body 12 may be formed as a single integrated structure in which the lip 17 of the inner container body 14 and the lip 19 of the outer container body 12 are continuous. Alternatively, the lip 17 of the inner container body 14 may be sealed with the lip 19 of the outer container body 12, using, for example, conventional sealing technologies such as thermal welding or crimping. In a preferred embodiment, the outer container body 12 is constructed with an insulating material to direct the heat toward the inner container body 14 and to keep the outside surface of the outer container body 12 from getting too hot for the user to hold. For example, the outer container body 12 can be made of an appropriate polyolefin. In one embodiment, the outer container body 12 includes a protruding, flexible bottom 26, which, in a relaxed state, protrudes downward. When a user exerts an upward force on the bottom 26, it can be pushed inward and directed to the inner container body 14. In one embodiment, the bottom 26 is integrally formed with the outer container body 12, using a molding process well-known in the art, such as injection molding or extrusion molding. Alternately, the bottom 26 can be sealed to the inside surface of the outer container body 12 using any welding process.

As shown in FIG. 1A, the reactant vessel 16 is disposed inside the outer container body 12, underneath the inner container body 14 in a spaced relationship. The outer surface 23 in the lower end of the reactant vessel 16 is secured to the inner surface 21 of the bottom 26. The reactant vessel 16 may be press fitted into the outer container body 12. Alternatively, the reactant vessel 16 may be attached to the bottom 26 using any sealing technology, including using an adhesive. The reactant vessel 16 is designed to hold one of the two reactants used to create a reaction which generates heat. For example, if water and calcium chloride are the two reactants used to create an exothermic reaction to generate heat, the reactant vessel 16 may contain either water or calcium chloride. As may be understood by a person skilled in the art, although this embodiment of the present invention is described with the use of water and calcium chloride, other materials capable of generating an exothermic reaction can be used in accordance with the present invention. The reactant vessel 16 can be made of any suitable material able to withstand heat such as polyethylene-terephtalalate glygol, polystyrene, or aluminum.

Referring to FIGS. 3A-3D, different dimensions of the reactant vessel 16 are shown, although the present invention is not limited to the illustrated dimensions, as will be easily appreciated by a person of ordinary skill in the art. In one embodiment, the reactant vessel 16 includes a flange 20 which extends circumferentially around the upper end of the reactant vessel 16. The flange 20 maintains the reactant vessel 16 snug within the outer container body 12 as shown in FIG. 1 and also separates the first chamber 12 into two compartments, an upper compartment 22 and a lower compartment 24. The upper compartment 22 is designed to hold a reactant (the "first reactant") which is to react with the reactant provided in the reactant vessel 16 (the "second reactant"). If the second reactant provided in the reactant vessel 16 is calcium chloride as shown in FIG. 1, the first reactant provided in the upper compartment 22 could be water. The flange 20 keeps all or most of the water from entering the lower compartment 24 before the self-heating step is initiated. In a preferred embodiment, the upper compartment 22 has sufficient amount of the first reactant such that when the container is inverted upside down as discussed below, the first reactant covers annularly the outer surface of the inner container body 14 to maximize the surface area of the inner container body 14 contacting the mixture of the first reactant reacting with the second reactant. This configuration provides efficient transfer of the heat generated to the substance to be heated. Although the preferred embodiments of the present invention are described with the use of water and calcium chloride, other materials capable of generating an exothermic reaction can be used in accordance with the present invention. For example, water can react with calcium oxide or a blend of anhydrous magnesium chloride and calcium chloride.

Referring back to FIG. 1A, the open, upper end of the reactant vessel 16 is covered with a breakable material which acts as a barrier to keep the second reactant from mixing with the first reactant before the self-heating reaction is activated. For example, the barrier 28 can be made of a foil such as an aluminum foil.

In one embodiment, the lower end of the reactant vessel 16 is sized and shaped to fit snuggly within the bottom 26 of the outer container body 14, such that when the bottom 26 is pushed towards the inner container body 14, the reactant vessel 16 is also moved towards the inner container body 14. The lower end of the reactant vessel 16 can be fastened to the inner surface of the bottom 26 to maintain the two in relative positions. The lower end of the reactant vessel 16 includes a radius of curvature which coincides with the radius of curvature provided in the bottom 26. This configuration allows the bottom 26 to propel upward easily when force is exerted against it and flex back to its original position.

Referring to FIGS. 1A, 1F, 1G, and 1H, the container 10 further includes a breaking device 30 disposed on or around the outer surface of the lower end 31 of the inner container body 14. In one embodiment, the breaking device 30 is in the form of a puncture ring, which, as shown in detail in FIGS. 1F-H, includes one or more blades 34 arranged in a star configuration on an exterior surface of the puncture ring. In one embodiment, each blade has two triangular surfaces that are disposed at an angle relative to each other in a manner such that the intersection of the two surfaces form a cutting edge. Preferably, the cutting edge of each blade is disposed at an angle relative to the plane of the exterior surface of the puncture ring and converges to a sharp point 31, preferably located near the center of the puncture ring, and faces downward to the barrier 28 and reactant vessel 16 underneath the barrier 28. The sharp point 31 is proximate to the barrier 28 such that when the bottom 26 is in the relaxed state, there is almost no contact but minimal distance between the sharp point 31 and the barrier 28, or between the blades 34 of the puncture ring 30 and the barrier 28, but when the bottom 26 is pushed toward the inner container body 14, the barrier 28 would come in contact with the blades 34 of the puncture ring 30, and ultimately, will be broken by the sharp point 31 and blades 34. The configuration of the breaking device 30 substantially minimizes the initial contact area between the breaking device and the barrier when the bottom is pushed toward the inner container body. As such, the pressure impact on the barrier is maximized when the barrier is first pierced, which in turn facilitates the barrier breaking process. The breaking device 30 can be made of any suitable material including a metallic material such as aluminum or a polymeric material. As can be appreciated by a skilled artisan, the number of the blades 34 may vary, as illustrated in FIGS. 1N, 1O, and 1P, from four to six or even more. In one embodiment, FIG. 1P shows that the breaking device 30 includes an outer surface ring 35 surrounding the blades 34, with the ring side being sharp. In operation, the outer surface ring 35, coupled with all the blades 34, makes it easier to cut open the barrier 28.

FIGS. 1K, 1L, and 1M show another embodiment of the breaking device 30'. Similar to the above-described breaking device 30, this device 30' is in the form of a puncture ring, which includes, in addition to the blades 31' converging to a central sharp point 32', a plurality of apertures or openings 33' which will allow the second reactant (e.g., water or other liquid material) in the lower compartment to go through and quickly mix with the first reactant in the upper compartment.

Referring to FIG. 1D, in one embodiment, the container 10 includes a pull tab lid 2, which, as shown in FIG. 1E in detail, covers the open surface of the inner container body 14 to keep inside the substance to be heated. The pull tab lid 2 can be made of any suitable material such as aluminum. In another embodiment, the container 10 includes a snap-on drinking lid 4, as shown in detail in FIGS. 1I-J. The drinking lid 4 includes an orifice to enable the consumer to consume the substance inside the container 10.

In one embodiment, the parts of the above-described container 10 are made of materials that can withstand at least the maximum temperature that would be reached from the exothermic reaction, which can be at least two hundred and fifty degrees Fahrenheit (250° F.).

In accordance with one embodiment of the present invention, when a user needs to heat the substance provided in the container 10, the user can invert the container 10 upside down as shown in FIG. 2, and then exert pressure on the bottom 26 to push the bottom towards the inner container body 14. The exerted pressure will push the bottom 26, together with the reactant vessel 16, towards the breaking device 30. As a consequence, the blades 34 of the breaking device will cut open the barrier 28, and the second reactant will be released into the first chamber 13 to mix with the first reactant. The user may shake the container 10 to facilitate mixture of the reactants, which creates an exothermic reaction to generate heat. Ultimately, the beverage or food substance provided inside the second chamber 15 will be heated. After the substance is heated, the user may remove the pull tab lid 2, and as an option, put the drinking lid 4 back on the container 10, for consuming the heated substance.

FIG. 4 provides a container 40 in accordance with an alternative embodiment of the present invention. The container 40 includes an outer container body 42 defining a first chamber 43, an inner container body 44 defining a second chamber 45 disposed within the outer container body 42, and a reactant vessel 46. The outer container body 42 includes a protruding, flexible bottom 48. The reactant vessel 46 is disposed inside the outer container body 42, underneath the inner container body 44 in a spaced relationship and a breaking device 50 in the form of a puncture ring is disposed between the inner container body 44 and the reactant vessel 46 covered by a breakable barrier 57. The puncture ring 50 rests on a rib 52 provided radially along the inside surface of the outer container body 42. In assembly, the puncture ring 50 may be snap fit into this position or using any other conventional means. The puncture ring 50 separates the first chamber 43 into an upper compartment and a lower compartment.

As shown in FIG. 5, the puncture ring 50 has a wheel-like construction. The ring 50 has an outer rim 53, a hub 56, and multiple spokes 54 which extend radially from the hub 56 to the outer rim 53. Each spoke 54 has a blade-like edge 55. An aperture or opening is positioned between each pair of adjacent spokes 54. In operation, the opening or aperture allows the second reactant held within the reactant vessel 46 to pass through the breaking device 50 to mix with the first reactant residing within the first chamber 43. The inclusion of such apertures can enhance the mixture of reactants, especially when the second reactant is water or other liquid. The hub 56 has a pointed end, which, along with the blade-like edges 55 of the spokes 54, makes it easier to puncture open the breakable barrier 57 when the breaking device 50 comes in contact with the barrier 57. The puncture ring 50 extends the entire cross section of the first chamber 43 and the width of the outer rim 54 is substantially equal to or slightly greater than the distance between the outer container body 42 and the inner container body 44. The puncture ring 50 is positioned such that it either contacts the bottom of the inner container body 44 or is substantially proximate to the bottom of the inner container body 44. In this configuration, the first reactant is substantially kept within the upper compartment of the first chamber 43.

Referring to FIG. 6, the container 60 according to another embodiment of the present invention, includes an outer container body 62 defining a first chamber 63, an inner container body 64 defining a second chamber 65 disposed within the outer container body 62, and a reactant vessel 66 covered by a breakable barrier 79. The reactant vessel 66 is disposed inside the outer container body 62, underneath the inner container body 64 in a spaced relationship. A breaking device 70 in the form of a puncture ring is secured to the bottom of the inner container body 64, between the inner container body 64 and the reactant vessel 66.

Referring to FIGS. 7A and 7B, the puncture ring 70 includes an outer rim 73, an inner rim 74, and a cutter 76. The puncture ring 70 includes multiple openings or apertures extending circumferentially between the outer rim 73 and the inner rim 74. The openings allow the second reactant held within the reactant vessel 66 to pass through the breaking device 70 to mix with the first reactant residing within the upper compartment of the first chamber 63. The cutter 76 comprises multiple protruding blades 78 which extend from the inner rim 74 and converge into a sharp point 77. The sharp point 77, along with the multiple blades 78, can puncture the barrier 79 when the breaking device 70 comes in contact with the barrier 79. In one embodiment, the puncture ring 70 extends the entire cross section of the first chamber 63 and the width of the outer rim 73 is substantially equal to or slightly greater than the distance between the outer container body 62 and the inner container body 64 and therefore keeps the first reactant within the upper compartment of the first chamber 63.

Referring to FIG. 8, the container 80 in accordance with another embodiment of the present invention includes an outer container body 82 defining a first chamber 83, an inner container body 84 defining a second chamber 85 disposed within the outer container body 82, and a reactant vessel 86. The reactant vessel 86 contains a first reactant and includes a breakable barrier 87 covering the lower end of the reactant vessel 86 to keep the first reactant within the vessel 86. In one embodiment, the reactant vessel 86 is integrated with the inner container body 85 so that one integral part is formed using the conventional molding or other technologies. Alternatively, the inner container body 85 and the reactant vessel 86 can be made of two pieces that are sealed together. The container 80 further includes a breaking mechanism 90 at the bottom of the container 80. The breaking mechanism 90 includes a piston wiper 92 sealed to the inner wall of the outer container body 82. As is well-known in the art, the piston wiper 92 typically includes a pair of longitudinally extending pins 94. In operation, when the piston wiper 92 is pushed and turned as illustrated in FIG. 9, the pair of pins 94 punctures and rips open the barrier 87 so as to release the second reactant from the reactant vessel 86 into the upper compartment of the first chamber 83 to mix with the first reactant provided within the upper compartment of the first chamber 83.

Referring to FIG. 10, the container 100 in accordance with another embodiment of the present invention includes an outer container body 102 defining a first chamber 103, an inner container body 104 defining a second chamber 105 disposed within the outer container body 102, and a reactant vessel 106 covered by a breakable barrier 109. The reactant vessel 106 is provided within the first chamber 103 below the inner container body 104 and mounted on a push and turn piston wiper 107. The container 100 further includes a serrated blade cutter 108 which is molded to the outer surface of the bottom of the inner container body 104. Alternatively, the serrated blade cutter 108 may be in the form of a puncture ring as shown in FIG. 10A. In operation, the piston wiper 107 is pushed and turned as shown in FIG. 11, and as a result, the reactant vessel 106 is pushed toward the inner container body 104 to make the barrier 109 come in contact with the cutter 108 and be broken by the cutter 108.

As presented in FIGS. 12A-C, in one embodiment, the inner container body 120 and the breaking device 122 may be formed as one integral part, in which configuration, the breaking device is included in the bottom surface of the inner container body 120. alternatively, the breaking device can be a separate part in contact with the inner container body in one of several ways as described above.

Referring to FIG. 13A, in another embodiment, the inner container body 130 has a breaking device 132 formed into the bottom surface of the inner container body 130. The breaking device 132, as further shown in 13A-1, includes multiple blades 134 extending from a distal point 136 to a proximal point 138 near the center of the device 132. The distal point 136 extends vertically further than the proximal point 138 such that when the breaking device 132 contacts the barrier, the distal point 136 contacts the outer perimeter of the barrier before the proximal point 138 contacts near the center of the barrier. This configuration allows the breaking device to break the barrier in a more efficient manner, which requires less force exerted upon the barrier. FIGS. 13A-2, 13A-3, and 13A-4 provide additional configurations of the breaking device, with various numbers, dimensions, or arrangements of the blades to be included into the breaking device.

Referring to FIGS. 13B and 13C, in another embodiment, a breaking device 131 is designed to be secured to the outer surface of the bottom of the inner container body. The breaking device 131 includes multiple blades 133 extending from a distal point 135 and converging to a proximal point 137 near the center of the device 131. The distal point 135 extends vertically further than the proximal point 137 such that when the breaking device 131 contacts the barrier, the distal point 135 would contact the outer perimeter of the barrier before the proximal point 137 comes into contact with the barrier. In this configuration, the barrier can be easily broken with less requirement of force to exert upon the barrier.

Additional embodiments of a breaking device are shown in FIGS. 18A-D, 19, 20A-B, 21, 22A-C, and 23A-E. Referring to FIGS. 18A-18C, the breaking device contains various configurations and arrangements of blades in the breaking device. For example, in FIG. 18A multiple blades extend from a distal point to a proximal point at the hub of the breaking device, and both the proximal point and the distal point extend vertically by the same distance. In FIG. 18B, each of the blades can be of a different length. In FIG. 18C, the breaking device includes, in addition a sharp proximal point near the center of the breaking device, a sharp distal point at the end of each blade. In FIG. 18D, multiple blades extend from a distal point to a proximal point at the hub of the breaking device, where the proximal point extends vertically further than the distal point.

Referring to FIG. 19, the breaking device 186 includes multiple diagonal blades 188 extending from a distal point 187 to a proximal point 189, and multiple inner blades that form a substantial square blade structure. The device 186 further includes a sharp hub point 191 in the center of the blade square.

Referring to FIGS. 20A-B, the breaking device include multiple blades extending from a distal point to a proximal point, where both the distal point and the proximal point extend the same distance vertically such that when the breaking device contacts the barrier, both the distal point and proximal point come into contact with the barrier simultaneously. Each blade can be arranged separately with even distance between adjacent blades, as shown in FIG. 20A. Alternatively, in FIG. 20B, each pair of adjacent blades can be such arranged that their proximal points overlap to form an angle of no more than 90 degrees.

Referring to FIG. 21, in another embodiment, the breaking device 196 includes multiple blades 199 in a serrated structure arranged circumferentially around the outer edge of the device 196.

Referring to FIGS. 22A-C, the breaking device 220 in accordance with one embodiment of the present invention includes a number of cones 201 evenly arranged and secured in the bottom surface of the breaking device 220 such that all the cone points are facing toward the barrier of the container. In one embodiment, the cones are evenly arranged on the bottom surface of the breaking device. In another embodiment, the cones 201 are arranged in a manner such that the distance between any two adjacent cones are substantially the same. In yet another embodiment, the cones 201 are arranged in a manner such that the distance between at least some of the adjacent cones are substantially the same. In yet another embodiment, the cones 201 are arranged symmetrically about an axis extending through the center of the breaking device 220. In operation, when a user exerts pressure on the bottom of the container, the cones 201 will come into contact with the barrier, and pierce the barrier open so as to make the reagents mix and react rapidly to generate heat. The use of cones in the breaking device can facilitate breaking the barrier and maximize the mixture of reagents, especially when the second reagent in the reactant vessel is a liquid that can flow through the apertures of the barrier caused by the cones. Another advantage of using cones to break the barrier is the pencil-tip-shaped configuration of the cones can substantially minimize the interference with the transfer of the solid reagent from the reactant vessel to the first chamber. In other words, minimal solid reactant will stay on the cones when it mixes and reacts with the liquid so that the exothermic reaction between the reactants will proceed fully as intended without sacrificing loss in heat generated due to some solid reactants left un-reacted. As may be understood by a skilled artisan, increasing the number of cones will enhance the efficiency of the breaking device. However, to include more cones in the breaking device will increase complexity in design as well as the tooling cost. In a preferred embodiment, the breaking device includes eight to ten cones.

FIGS. 23A-E provide another embodiment of the breaking device 230. As shown in FIGS. 23A-23C, the breaking device 230 comprises a number of cones 231 arranged and secured in the surface of one side of the breaking device, and a number of extensions 232 secured around the edge of the breaking device, with a space, such as a slot, between each pair of extensions 232. Preferably, the cones are evenly arranged in a manner such the cones are symmetrical about an axis extending through the center of the breaking device. In one embodiment, all of the extensions together form a rim extending in the opposite direction as the cone points. In one embodiment, each extension 232 is made of flexible material. In assembly, an extension 232 can be secured onto the edge of the breaking device using the conventional technologies such as molding in slots. As further illustrated in FIGS. 23D-E, the rim formed by the plurality of extensions 232 will fit snug against the inside wall of the outer container body 12, thereby separating the first chamber of the outer container body 12 into an upper compartment 22 and a lower compartment 24. In one embodiment of the present invention, solid reactant such as chemicals is placed above the breaking device and maintained within the upper compartment substantially by the extensions as long as each slot width is sufficiently small to keep the solid reactants from passing through. When activated, the liquid reactant such as water will be released from the reactant vessel and pass through the slots between extensions to mix and react with the solid reactant within the upper compartment. This configuration of the breaking device provides an advantage of keeping the generated heat close to the inner container body 14, thereby maximizing the heat exchange effect.

Referring to FIGS. 14A-F, in another embodiment, the breaking device 140 is inserted inside the reactant vessel 142 that is covered by the barrier 145. The breaking device 140 includes a lower hub 143, multiple spokes 147 extending radically from the hub 143, and blades 144 extending substantially orthogonally from the spokes 147 towards the barrier 145 and ending in an edge 141 within a sufficient distance to the barrier for operating the heat-generating step. The lower hub 143 can be constructed with a flexible material and is positioned to retain substantial contact with the lower end 149 of the reactant vessel 142. Each blade 144 is of sufficient height that when pressure is exerted against the lower hub 143, the lower hub 143 flexes towards the barrier 145, resulting in the blades 144 moving towards the barrier 145 and the edges 141 and puncturing open the barrier 145 to release the reactant reside within the vessel 142.

Referring to FIG. 15, the container 150 according to another embodiment of the present invention includes an outer container body 152 defining a first chamber 153 and an inner container body 154 defining a second chamber 155 disposed within the outer container body 152. The container 150 further includes an insulating layer 156 provided along the inner surface of the outer container body 152 to enhance insulation of the container 150. The insulating layer 156 can be made of any suitable insulating material such as styrofoam. The insulating layer 156 can be in the form of a sleeve. The insulating layer 156 can form the walls of the first chamber 153, which is the reaction chamber, to ensure that the heat generated from an exothermic reaction will be kept and directed to the inner container body 154 and the outer surface of the container will not be getting too hot for a consumer to hold. The insulating layer 156 can be used with any of the containers described in this application.

In one embodiment, the insulating sleeve 156 is structurally molded resulting in a rigid foam, such as an expanded polystyrene foam, which is contoured to the inner shape of the outer container body 152. The insulating sleeve 156 may be designed to drop into place within the outer container body 152 and be secured by friction. In one embodiment, the insulating sleeve 156 insulates the entire inner surface of he outer container body 152 as illustrated in FIG. 15. In one embodiment, the inner surface of the insulating sleeve 156 may be textured to assist agitation and reaction of the first and second reactants. For example, the insulating sleeve 156 may have a surface roughness of no less than 0.001 inches. In one embodiment, the insulating sleeve is resistant to high heat and compatible with the heating slurry formed by the mixture of the first and second reactants. In one embodiment, the insulating sleeve density can be adjusted to result in the highest insulating values required by the design and specification of the container.

In one embodiment of the invention, the insulating sleeve can be manufactured using a process called "Dry Heat Expansion". In this process, multiple spherical beads, each of which is of an approximate size of granular salt, are positioned in a mold to form the insulating sleeve. After heat is introduced to the mold, the granular beads expand to fill the mold cavity, with their density decreasing from 39 lb/cubic ft. to 3 lbs/cubic ft or below, depending on the specific thickness limits set for the insulating sleeve. The expanded beads may form a smooth insulating surface, or be further adjusted using any one of the conventional processes to generate certain roughness in the surface, such as an "orange peel" condition.

In one embodiment, the container 150 includes a reaction chamber 155 in which the exothermic reaction takes place. The container also includes an inner container 154 disposed inside the reaction chamber 155. The reaction chamber 155 has a plurality of walls 156 made of a material with a thermal conductivity selected to substantially inhibit heat generated from the exothermic reaction from transferring from the reaction chamber 155 through the walls to the exterior of the chamber. In one embodiment, the exothermic reaction product comprises a heated water based mixture. Preferably, the material comprising the reaction chamber wall is in direct contact with the exothermic reaction product and has a non-smooth surface texture adapted to assist the release of molecules or bubbles when water vapor or steam is generated due to the exothermic reaction in the reaction chamber. In one embodiment, the material has a surface roughness of at least 0.001 inch.

Referring to FIGS. 16A-C, an improved feature on the lip of the container will be described. As described above, with reference back to FIG. 1A, the lip 17 of the inner container body 14 and the lip 19 of the outer container body 12 can be continuous. However, there is a disadvantage of this configuration: if the inner container body 14 is made of a thermally conductive material such as aluminum, the lip 17 or 19, as part of the inner container body 14, can become hot when the inner container body 14 is heated. This will make it difficult for the user to consume the heated beverage or food products immediately. To address this problem, the container 160 in FIGS. 16A-C includes a lip 162 made of an insulating material, such as plastic. The lip 162, substantially annular in shape, is sized and shaped to reside at the upper tip of container 160. In one embodiment, the lip 162 includes a lower planar portion 164 which includes a slit, which is sized and shaped to receive an upper end portion 166 of the inner container body 168 to secure the inner container body 168 to the lip 162. The lip 162 also includes an upper curved portion 169 extending substantially orthogonally from the planer lower portion 162. The upper curved portion 169 is sized and shaped to receive an upper end portion 167 of the outer container body 161. Accordingly, the lip 162 secures the inner container body 168 with the outer container body 161 at their upper end portions. In an alternative embodiment, the lip 162 may be integrated with the drinking lid referenced in FIGS. 1I-J as one unitary structure using conventional technologies such as a molding technology.

Referring to FIGS. 17A and 17B, in one embodiment, the container 170 includes an inner container body 172 and an outer container body 174 where the two bodies are secured using a double seam 171, which can be constructed using technologies well-known in the art. The container 170 further includes a breaking mechanism 176 secured to the outer bottom of the inner container body 172. The breaking mechanism 176 includes multiple blades 177 extending from a distal sharp point 178 and converging to a proximal sharp point 179. The distal sharp point 178 extends further than the proximal sharp point 179 such that when the breaking device 177 contacts the barrier 173, the distal sharp point 178 contacts the outer perimeter of the barrier 173 before the proximal sharp point 179 contacts the center of the barrier 173. As described above, this configuration allows the breaking mechanism to work more efficiently in breaking the barrier 173, with less force required from a user.

In one embodiment, the containers described above are manufactured and assembled in the following process. The reactant vessel can be separately manufactured using any conventional manufacturing method such as thermoforming or injection molding. In one embodiment, the reactant vessel is filled with the solid reactant such as calcium chloride and covered with a foil sealed to the reactant vessel. Alternatively, the reactant vessel is filled with liquid reactant such as water and covered with a waterproof material, such as foil, to be secured to the reactant vessel. The separation of the reactant vessel from the final container product provides flexibility to the manufacturer that can always check each individual sealed reactant vessel prior to assembling it into the rest of the container. The outer container body and the inner container body can be separately manufactured using conventional manufacturing methods such as injection molding. The breaking device can be made as one integral part of the inner container body. As an alternative, the breaking device can be separately made using injection molding or other methods and then secured to the inner container body. After each individual piece is manufactured, they can be assembled following the steps below. First, the outer container body is placed into a holder in a filling line. Subsequently, an adhesive is provided on the inner bottom of the outer container body where the reactant vessel will be secured. Then, the reactant vessel is placed inside the outer container body and secured to the bottom by means of the pre-applied adhesive. One reactant, such as calcium chloride or water, is placed in the outer container body. The inner container body is placed into the outer container body in a manner such that the reactant placed in the outer container body will surround the inner container body, and the bottom of the inner container body is proximate to but has no direct contact with the reactant vessel. Beverage, food or other consumable products can be sealed inside the inner container body using a pull tab lid to be placed on top of the inner container body. The inner container and the pull tab lid are crimped to the outer container body making a seal using a conventional method. The underside of the pull tab lid can be coated with any FDA approved coating to protect the beverage or food products from contacting raw aluminum. A snap-on drinking lid is placed on top of the outer container. Other appropriate manufacturing and assembling methods well known to those skilled in the art may also be employed to manufacture and assemble the containers of the present invention.

In operation, a user may press the bottom of the outer container body toward the inner container body, and as a result of the force exerted upon the bottom, the reactant vessel will move with the bottom and be pushed toward the breaking device at the outer bottom of the inner container body so that the breaking device comes into contact with and breaks the barrier, namely, cover of the reactant vessel. Subsequently, the reactant within the reactant vessel will be released from the vessel and mix with the other reactant provided within the outer container body and surrounding the inner container body. The heat generated from the exothermic reaction between the two reactants will be transferred and exchanged to heat up the substance in the inner container body. When the substance is heated and ready to be consumed, the user can remove the pull tab lid and put the snap-on drinking lid back on the container. To maximize and facilitate the mixture of two reactants, the user can invert the container upside down before pressing the bottom of the outer container body, and optionally, shake the container after the barrier of the reactant is broken to cause the mixture.

As can be appreciated by a person of ordinary skill in the relevant field, the containers described above can be used not only for self-heating but also for self-cooling when appropriate reactants are used to create an endothermic reaction having cooling impact.

Other embodiments and uses of the invention will be apparent to those skilled in the art from consideration of the specification and practice of the invention disclosed herein. Although the invention has been particularly shown and described with reference to several preferred embodiments thereof, it will be understood by those skilled in the art that various changes in the form and details may be made therein without departing from the spirit and scope of the invention.

What is claimed is:

1. A container comprising:

an outer container body defining a first chamber comprising a first reactant;

an inner container body defining a second chamber adapted to hold a substance to be heated or cooled, wherein the inner container body is disposed within the first chamber and secured directly to the outer container via an attaching lip;

a reactant vessel provided within the first chamber adjacent to the inner container body, wherein the reactant vessel contains a second reactant capable of reacting with the first reactant to generate an exothermic or endothermic reaction;

a breakable barrier covering the reactant vessel; and a breaking device comprising an annular disc having a central aperture disposed within outside of the reactant vessel so that an outside perimeter of the annular disc is in contact with an inner wall of the outer container and disposed the first chamber between the inner container body and the reactant vessel and entirely above the breakable barrier, wherein the breaking device comprises a plurality of protrusions fixed to the annular disc extending radially outward and downward to a central tip and evenly arranged in the central aperture throughout the breaking device to efficiently break the barrier and quickly release the first reactant to mix and react with the second reactant and wherein the breaking device further comprises a plurality of openings located on the annular disc to allow the first reactant to quickly mix with the second reactant, wherein at least some of the openings are positioned between adjacent protrusions.

2. The container of claim 1, wherein the plurality of protrusions are a plurality of cone shaped structures extending outwardly along a radial axis of the breaking device, said structures having a tapered distal end.

3. The container of claim 1, wherein the breaking device comprises a puncture ring integrated as part of the inner container body.

4. The container of claim 2, wherein the breaking device comprises five to nine cone shaped structures.

5. The container of claim 1, further comprising an insulating layer disposed along an inside surface of the outer container body.

6. The container of claim 1, wherein the first reactant is solid and the second reactant is liquid.

7. A container comprising:

an outer container body defining a first chamber comprising a first reactant;

an inner container body defining a second chamber adapted to hold a substance to be heated or cooled, wherein the inner container body is disposed within the first chamber and secured directly to the outer container via an attaching lip;

a reactant vessel provided within the first chamber adjacent to the inner container body, wherein the reactant vessel comprises a second reactant capable of reacting with the first reactant to generate an exothermic or endothermic reaction;

a breakable barrier covering the reactant vessel; and a breaking device comprising an annular disc having a central aperture disposed outside of the reactant within the first chamber between the inner container body and the reactant vessel and entirely above the breakable barrier, wherein the breaking device comprises a plurality of breaking members fixed to the central aperture of the annular disc extending along a radial axis to a tip of the annular disc of the breaking device for breaking the barrier, and further comprises a rim extending around an outer perimeter of the annular disc of the breaking device to separate the first chamber into an upper compartment and a lower compartment thereby keeping the first reactant substantially within the upper compartment wherein the outer perimeter is in contact with an inner wall of the outer container, and further comprises a plurality of apertures positioned on the annular disc in between the breaking members to allow the first reactant to quickly mix with the second reactant.

8. The container of claim 7, wherein the rim comprises a plurality of extensions, where adjacent extensions are separated by a space.

9. The container of claim 8, wherein the first reactant comprises solid particles and a width of the space is sized to keep the first reactant substantially within the upper compartment.

10. The container of claim 9, wherein the breaking device comprises a plurality of protrusions evenly arranged throughout the breaking device to efficiently break the barrier and quickly release the second reactant to mix and react with the first reactant.

11. A container comprising:

an outer container body defining a first chamber comprising a first reactant;

an inner container body defining a second chamber adapted to hold a substance to be heated or cooled, wherein the inner container body is disposed within the first chamber and secured directly to the outer container via an attaching lip;

a reactant vessel provided within the first chamber adjacent to the inner container body, wherein the reactant vessel contains a second reactant capable of reacting with the first reactant to generate an exothermic or endothermic reaction;

a breakable barrier covering the reactant vessel; and a breaking device comprising an annular disc having a central aperture disposed outside of the reactant vessel so that an outside perimeter of the annular disc is in contact with an inner wall of the outer container and disposed within the first chamber between the inner container body and the reactant vessel and entirely above the breakable barrier, wherein the breaking device comprises a plurality of protrusions, wherein the protrusions fixed to the annular disc extend radially outward and downward from the central aperture to a central tip and configured for breaking the barrier by contacting the outer perimeter of the barrier prior to contacting the center of the barrier to release the first reactant into the reactant vessel to mix and react with the second reactant, and wherein the breaking device comprises a plurality of openings disposed on the annular disc between adjacent protrusions to allow the first reactant to quickly mix with the second reactant.

12. The container of claim 11, wherein the plurality of protrusions comprises a plurality of blades with each blade extending from a distal point to a proximal point near center of the device.

13. The container of claim 11, wherein the distal point extends further than the proximal point for the distal point to contact an outer edge of the barrier before the proximal point contacts near center of the barrier.

14. The container of claim 11, further comprising an insulating layer disposed inside the outer container body.

15. A container comprising:

an outer container body defining a first chamber comprising a first reactant;

an inner container body defining a second chamber for holding a substance to be heated or cooled, wherein the inner container body is disposed within the first chamber;

an insulating lip disposed at and secured to an upper end of the outer container and an upper end of the inner container body;

a reactant vessel provided within the first chamber underneath the inner container body, wherein the reactant vessel contains a second reactant capable of reacting with the first reactant to generate an exothermic or endothermic reaction;

a breakable barrier covering the reactant vessel; and a breaking device comprising an annular disc having a central aperture disposed outside the reactant vessel so that an outside perimeter of the annular disc is in contact with the inner wall of the outer container and disposed within the first chamber between the inner container body and the reactant vessel and entirely above the breakable barrier, the breaking device comprising a plurality of protrusions fixed to the central aperture and extending outwardly and downwardly to a tip along a radial axis of the breaking device and a plurality of apertures evenly arranged on the annular disc between the protrusions throughout the breaking device to allow the first reactant to quickly mix with the first reactant, the breaking device configured for breaking the barrier to cause the mixture of the first and second reactants.

16. The container of claim 15, wherein the insulating lip comprises a lower planar portion for securing the inner container body and an upper curved portion for securing the outer container body.

17. The container of claim 16, wherein the lower planar portion includes a slit to receive the upper end of the inner container body.

18. The container of claim 16, wherein the upper curved portion extends substantially orthogonally from the lower planar portion.

19. A self heating container comprising:

a reaction chamber comprising a first reactant, said reaction chamber having a plurality of walls, wherein the walls comprise a material selected to substantially inhibit heat transfer through the walls of the reaction chamber, wherein the material has a non-smooth surface texture and is positioned to be in direct contact with reaction products formed in the reaction chamber to assist release of molecules for steam generation in reaction products;

a breaking device comprising an annular disc having a central aperture a plurality of protrusions fixed to the central aperture extending outwardly and downwardly to a tip along a radial axis of the annular disc from the central aperture of the breaking device and a plurality of pairs of extensions around an edge of the breaking device with a slot located on the annular disc between each pair of extensions;

a first housing containing a substance to be heated, said first housing is disposed inside the reaction chamber and secured directly to the outer container via an insulating lip; and a second housing comprising a second reactant, said second reactant is separated from the first reactant in the reaction chamber by a breakable barrier the breakable barrier located below the entire breaking device, wherein upon breaking of the barrier, the first and second reactants contact and react with each other to generate sufficient heat to raise the temperature of the substance inside the first housing to a first level.

20. The container of claim 19 wherein the material comprising the walls of the reaction chamber extends substantially along an entire inner surface of the reaction chamber.

21. The container of claim 19 wherein the material comprising the walls of the reaction chamber has a surface roughness of no less than 0.001 inch.

22. The container of claim 19 wherein the material comprising the walls of the reaction chamber is structurally molded and follows the contours of the container body.

* * * * *